US009486997B2

(12) United States Patent
Kamiyanagi

(10) Patent No.: US 9,486,997 B2
(45) Date of Patent: Nov. 8, 2016

(54) PRINTING APPARATUS, CONTROL METHOD FOR PRINTING APPARATUS, AND CONTROL PROGRAM FOR PRINTING APPARATUS

(71) Applicant: Seiko Epson Corporation, Tokyo (JP)

(72) Inventor: Masashi Kamiyanagi, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/990,079

(22) Filed: Jan. 7, 2016

(65) Prior Publication Data

US 2016/0236463 A1 Aug. 18, 2016

(30) Foreign Application Priority Data

Feb. 18, 2015 (JP) ..... 2015-029859

(51) Int. Cl.
*B41J 2/045* (2006.01)
*B41J 2/165* (2006.01)
*B41J 2/21* (2006.01)

(52) U.S. Cl.
CPC ..... *B41J 2/0451* (2013.01); *B41J 2/04541* (2013.01); *B41J 2/04581* (2013.01); *B41J 2/165* (2013.01); *B41J 2/16579* (2013.01); *B41J 2/2139* (2013.01); *B41J 2/2142* (2013.01)

(58) Field of Classification Search
CPC .... B41J 2/0451; B41J 2/2139; B41J 2/2142; B41J 2/16579; B41J 2/165; B41J 2/04581; B41J 2/04541
See application file for complete search history.

(56) References Cited

U.S. PATENT DOCUMENTS

2005/0212845 A1* 9/2005 Shinkawa ..... B41J 2/0451 347/19
2007/0243104 A1* 10/2007 Aoki ..... B41J 2/17566 422/400
2013/0257945 A1* 10/2013 Shinkawa ..... B41J 2/04541 347/10
2013/0293610 A1* 11/2013 Suzuki ..... B41J 2/04541 347/10
2013/0307896 A1* 11/2013 Shinkawa ..... B41J 29/393 347/19
2015/0062219 A1* 3/2015 Otokita ..... B41J 2/04541 347/10
2015/0062226 A1* 3/2015 Otokita ..... B41J 2/0451 347/14
2015/0158293 A1* 6/2015 Suzuki ..... B41J 2/04588 347/9
2015/0202872 A1* 7/2015 Komatsu ..... B41J 2/0451 347/70
2015/0258780 A1* 9/2015 Hayashi ..... B41J 2/04581 347/6
2015/0352841 A1* 12/2015 Horie ..... B41J 2/0451 347/10
2015/0367633 A1* 12/2015 Murate ..... B41J 2/04588 347/10

FOREIGN PATENT DOCUMENTS

JP 09-024609 A 1/1997
JP 2004-174816 A 6/2004

* cited by examiner

*Primary Examiner* — Justin Seo

(74) *Attorney, Agent, or Firm* — Harness, Dickey & Pierce, P.L.C.

(57) ABSTRACT

A printing apparatus includes a first piezoelectric element; a first cavity; a first nozzle; a second piezoelectric element; a second cavity; a second nozzle; a drive signal generating unit that generates a drive signal; a residual vibration detecting unit that detects the first residual vibration signal and the second residual vibration signal; a discharge state determining unit that determines the state of discharge from the first nozzle from the first residual vibration signal and determines the state of discharge from the second nozzle from the second residual vibration signal; and a setting unit that sets the frequency of detection of the first residual vibration signal to be higher than the frequency of detection of the second residual vibration signal.

7 Claims, 20 Drawing Sheets

EXPERIMENTAL VALUE AND CALCULATED VALUE OF RESIDUAL VIBRATION (AIR BUBBLE)

EXPERIMENTAL VALUE AND CALCULATED VALUE OF RESIDUAL VIBRATION (DRY)

FIG. 15

| INSPECTION INSTANCE | ... | k | k+1 | k+2 | k+3 | k+4 | k+5 | k+6 | k+7 | ... |
|---|---|---|---|---|---|---|---|---|---|---|
| INSPECTION TARGET COLOR | ... | BLACK | CYAN | BLACK | MAGENTA | BLACK | YELLOW | BLACK | CYAN | ... |

FIG. 17

| SI (b1, b2, b3) | Ts1 | | | Ts2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

FIG. 23

| Flag | Tc (CONTENT OF COMPARISON) | Rs |
|---|---|---|
| 1 | Tc < Tth1 | 2: ABNORMAL DISCHARGE (AIR BUBBLE) |
| | Tth1 ≤ Tc ≤ Tth2 | 1: NORMAL |
| | Tth2 < Tc ≤ Tth3 | 3: ABNORMAL DISCHARGE (PAPER DUST) |
| | Tth3 < Tc | 4: ABNORMAL DISCHARGE (THICKENING) |
| 0 | N/A | 5: ABNORMAL DISCHARGE |

PRINTING APPARATUS, CONTROL METHOD FOR PRINTING APPARATUS, AND CONTROL PROGRAM FOR PRINTING APPARATUS

This Application claims priority to Japanese Patent Application No. 2015-029859 filed on Feb. 18, 2015. The entire disclosure of Japanese Patent Application No. 2015-029859 is hereby incorporated herein by reference.

BACKGROUND

1. Technical Field

The present invention relates to a printing apparatus discharging liquid drops to perform printing, a control method for a printing apparatus, and a control program for a printing apparatus.

2. Related Art

A printing apparatus that forms a print target such as an image on a medium such as paper with ink discharged from nozzles may not normally discharge ink from the nozzles because of thickening or the like of ink. When an abnormal discharge that is a state where ink cannot be normally discharged from a nozzle occurs, that is, when the state of the discharged ink is abnormal, a dot that is supposed to be formed by the ink discharged from the nozzle is not formed, and this degrades the quality of the print target formed on the medium. In order to suppress such quality degradation due to failure of dot formation, there are suggested various types of technology in which when an abnormal discharge occurs in one nozzle, another nozzle discharges ink to form a dot instead of discharging ink from the one nozzle. That is, technologies for complementing one nozzle in which an abnormal discharge occurs with another nozzle are suggested.

In JP-A-9-024609, for example, there is suggested a technology for complementing one nozzle with another nozzle when an abnormal discharge occurs in one nozzle, by increasing the amount of ink discharged from another nozzle that is adjacent to the one nozzle.

In JP-A-2004-174816, there is suggested a technology for complementing one nozzle with another nozzle when an abnormal discharge occurs in one nozzle discharging ink of one color, by increasing the amount of ink discharged from another nozzle that discharges ink of another color.

The above printing apparatus performs discharge state inspection that is an inspection of whether an abnormal discharge occurs in a nozzle. Generally, such discharge state inspection is performed between a printing process performed on one medium and a printing process performed on the medium subsequent to the one medium when a print target is formed on a plurality of media. At this time, in order to reduce load on the printing apparatus necessitated by determination of whether an abnormal discharge occurs as well as complementation based on the determination result, determination of a discharge state is performed on a part of a plurality of discharging units, each including one nozzle, in one instance of the discharge state inspection. Each time one instance of the discharge state inspection is performed, the inspection target discharging unit changes in order. When a plurality of instances of the discharge state inspection elapses, the rounds of the inspection target discharging units are made, and determination of the discharge state of all of the discharging units is completed. When the rounds of the inspection target discharging units are made, determination of a discharge state is again repeated for each discharging unit in the same order.

For example, when the printing apparatus is configured to include individual discharging units for black, cyan, magenta, and yellow, a discharging unit that discharges black ink is targeted for inspection in the first discharge state inspection, and a discharging unit that discharges cyan ink is targeted for inspection in the second discharge state inspection. In addition, a discharging unit that discharges magenta ink is targeted for inspection in the third discharge state inspection, and a discharging unit that discharges yellow ink is targeted for inspection in the fourth discharge state inspection. Then, the discharge state of the discharging unit is repeatedly determined in the order of the black discharging unit, the cyan discharging unit, the magenta discharging unit, and the yellow discharging unit.

As such, determination of the discharge state of one discharging unit is performed only once in each of a plurality of instances of the discharge state inspection for one of the color discharging units. Therefore, when, for example, an abnormal discharge occurs in the black discharging unit immediately after the discharge state thereof is determined in the first discharge state inspection in the above example, the abnormal discharge is not detected until the fifth discharge state inspection. In addition, a dot that is supposed to be formed by the discharging unit where the abnormal discharge is detected is omitted until a complementation process or a maintenance process is performed on the discharging unit where the abnormal discharge is detected, and printing continues with degraded image quality.

Particularly, when a general paper such as a document is formed, there is ink that is frequently used in forming a print target, such as black ink. If an abnormal discharge occurs in a discharging unit that discharges such frequently used ink and the absence of either a complementation process or a maintenance process continues, formation of a print target continues in a state where image quality is significantly degraded, thereby causing wasteful consumption of a medium.

SUMMARY

An advantage of some aspects of the invention is to provide a printing apparatus capable of determining the state of liquid discharged from each of a plurality of nozzles, a control method for a printing apparatus, and a control program for a printing apparatus so as to suppress continuous formation of a print target in a state where image quality is degraded.

Hereinafter, means of the invention and operation effects thereof will be described.

According to an aspect of the invention, there is provided a printing apparatus including a first piezoelectric element; a first cavity that is filled with a first liquid, the pressure inside the first cavity being increased or decreased by displacement of the first piezoelectric element; a first nozzle that communicates with the first cavity and discharges the first liquid as a liquid drop by an increase or a decrease in the pressure inside the first cavity; a second piezoelectric element; a second cavity that is filled with a second liquid, the pressure inside the second cavity being increased or decreased by displacement of the second piezoelectric element; a second nozzle that communicates with the second cavity and discharges the second liquid as a liquid drop by an increase or a decrease in the pressure inside the second cavity; a drive signal generating unit that generates a drive signal displacing the first piezoelectric element as well as the second piezoelectric element, causes a first residual vibration signal to occur in the first piezoelectric element in response to an increase or a decrease in the pressure inside the first cavity due to application of the drive signal to the first piezoelectric element, and causes a second residual vibration signal to occur in the second piezoelectric element in response to an increase or a decrease in the pressure inside the second cavity due to application of the drive signal to the second piezoelectric element; a residual vibration detecting unit that detects the first residual vibration signal and the second residual vibration signal; a discharge state determining unit that determines the state of discharge from the first nozzle from the first residual vibration signal and determines the state of discharge from the second nozzle from the second residual vibration signal; and a setting unit that sets the frequency of detection of the first residual vibration signal to be higher than the frequency of detection of the second residual vibration signal.

In this case, the frequency of determination of the state of the first liquid discharged from the first nozzle is higher than the frequency of determination of the state of the second liquid discharged from the second nozzle. Therefore, when an abnormal discharge occurs in the first nozzle, the occurrence of an abnormal discharge in the first nozzle is detected early in comparison with the case where determination of a discharge state is equally performed on these nozzles. As a consequence, a counteraction to the abnormal discharge such as a complementation process or a maintenance process can be performed early on the first nozzle. In the above configuration, the first liquid may be a liquid that significantly affects the image quality of a print target formed by discharge of the liquid or may be a liquid that is likely to cause an abnormal discharge, and the state of liquid discharged from each of the plurality of nozzles can be determined in such a manner that continuous formation of the print target in the state where image quality is degraded is suppressed.

It is preferable that the printing apparatus further includes a third piezoelectric element; a third cavity that is filled with a third liquid, the pressure inside the third cavity being increased or decreased by displacement of the third piezoelectric element; and a third nozzle that communicates with the third cavity and discharges the third liquid as a liquid drop by an increase or a decrease in the pressure inside the third cavity, in which the drive signal generated by the drive signal generating unit displaces the third piezoelectric element and causes a third residual vibration signal to occur in the third piezoelectric element in response to an increase or a decrease in the pressure inside the third cavity due to application of the drive signal to the third piezoelectric element, the residual vibration detecting unit further detects the third residual vibration signal, the discharge state determining unit further determines the state of discharge from the third nozzle from the third residual vibration signal, and the setting unit sets the frequency of detection of the first residual vibration signal to be higher than each of the frequency of detection of the second residual vibration signal and the frequency of detection of the third residual vibration signal.

In this case, the frequency of determination of the state of the first liquid discharged from the first nozzle is higher than each of the frequency of determination of the state of the second liquid discharged from the second nozzle and the frequency of determination of the state of the third liquid discharged from the third nozzle. Therefore, an abnormal discharge of the first nozzle is detected particularly early, and a counteraction to the abnormal discharge of the first nozzle can be performed early. Thus, even if the printing apparatus includes three or more nozzles, the state of liquid discharged from each of the plurality of nozzles can be determined in such a manner that continuous formation of a print target in the state where image quality is degraded is suppressed.

It is preferable that in the printing apparatus, the frequency of discharge of the first liquid from the first nozzle is higher than each of the frequency of discharge of the second liquid from the second nozzle and the frequency of discharge of the third liquid from the third nozzle.

If an abnormal discharge occurs in a nozzle that frequently discharges liquid, the image quality of a print target is significantly degraded. In the above case, the frequency of determination of the state of discharge in the nozzle that frequently discharges liquid is high. Thus, an abnormal discharge in such a nozzle is detected early, and a counteraction to the abnormal discharge can be performed early. As a consequence, the period during which a print target is formed in the state where image quality is significantly degraded can be shortened.

It is preferable that in the printing apparatus, the first liquid is black ink, and each of the second liquid and the third liquid is ink of one of cyan, magenta, and yellow.

In this case, the frequency of determination of the discharge state of a nozzle that discharges black ink is higher than the frequency of determination of the discharge state of a nozzle that discharges ink of one of cyan, magenta, and yellow. Generally, black ink tends to be frequently used in the printing apparatus. If an abnormal discharge occurs in a nozzle that discharges frequently used ink, the image quality of a print target formed is significantly degraded. Regarding this point, in the above case, an abnormal discharge of a nozzle that discharges frequently used ink is detected early, and a counteraction to such an abnormal discharge can be performed early. As a consequence, the period during which a print target is formed in the state where image quality is significantly degraded can be shortened.

It is preferable that in the printing apparatus, detection of the first residual vibration signal is performed after detection of the second residual vibration signal and after detection of the third residual vibration signal.

In this case, the frequency of determination of the state of the first liquid discharged from the first nozzle can be set to be higher than each of the frequency of determination of the state of the second liquid discharged from the second nozzle and the frequency of determination of the state of the third liquid discharged from the third nozzle with a simple configuration.

According to another aspect of the invention, there is provided a control method for a printing apparatus including a first piezoelectric element; a first cavity that is filled with a first liquid, the pressure inside the first cavity being increased or decreased by displacement of the first piezoelectric element; a first nozzle that communicates with the first cavity and discharges the first liquid as a liquid drop by an increase or a decrease in the pressure inside the first cavity; a second piezoelectric element; a second cavity that is filled with a second liquid, the pressure inside the second cavity being increased or decreased by displacement of the second piezoelectric element; a second nozzle that communicates with the second cavity and discharges the second liquid as a liquid drop by an increase or a decrease in the pressure inside the second cavity; a drive signal generating unit that generates a drive signal displacing the first piezoelectric element as well as the second piezoelectric element, causes a first residual vibration signal to occur in the first piezoelectric element in response to an increase or a decrease in the pressure inside the first cavity due to application of the drive signal to the first piezoelectric element, and causes a second residual vibration signal to occur in the second piezoelectric element in response to an increase or a decrease in the pressure inside the second cavity due to application of the drive signal to the second piezoelectric element; a residual vibration detecting unit that detects the first residual vibration signal and the second residual vibration signal; and a discharge state determining unit that determines the state of discharge from the first nozzle from the first residual vibration signal and determines the state of discharge from the second nozzle from the second residual vibration signal, in which the frequency of detection of the first residual vibration signal is set to be higher than the frequency of detection of the second residual vibration signal.

In this case, the same operation effect as the above printing apparatus can be obtained in the control method for a printing apparatus.

According to still another aspect of the invention, there is provided a control program that causes a printing apparatus including a first piezoelectric element; a first cavity that is filled with a first liquid, the pressure inside the first cavity being increased or decreased by displacement of the first piezoelectric element; a first nozzle that communicates with the first cavity and discharges the first liquid as a liquid drop by an increase or a decrease in the pressure inside the first cavity; a second piezoelectric element; a second cavity that is filled with a second liquid, the pressure inside the second cavity being increased or decreased by displacement of the second piezoelectric element; a second nozzle that communicates with the second cavity and discharges the second liquid as a liquid drop by an increase or a decrease in the pressure inside the second cavity; a drive signal generating unit that generates a drive signal displacing the first piezoelectric element as well as the second piezoelectric element, causes a first residual vibration signal to occur in the first piezoelectric element in response to an increase or a decrease in the pressure inside the first cavity due to application of the drive signal to the first piezoelectric element, and causes a second residual vibration signal to occur in the second piezoelectric element in response to an increase or a decrease in the pressure inside the second cavity due to application of the drive signal to the second piezoelectric element; a residual vibration detecting unit that detects the first residual vibration signal and the second residual vibration signal; and a discharge state determining unit that determines the state of discharge from the first nozzle from the first residual vibration signal and determines the state of discharge from the second nozzle from the second residual vibration signal to function as a setting unit which sets the frequency of detection of the first residual vibration signal to be higher than the frequency of detection of the second residual vibration signal.

In this case, the same operation effect as the above printing apparatus can be obtained in the control program for a printing apparatus.

BRIEF DESCRIPTION OF THE DRAWINGS

The invention will be described with reference to the accompanying drawings, wherein like numbers reference like elements.

FIG. 6A illustrates the sectional shape in the initial state, FIG. 6B illustrates the sectional shape in a state where strain occurs in a piezoelectric element, and FIG. 6C illustrates the sectional shape in a state where the strain on the piezoelectric element is recovered.

FIG. 15 is a correlation diagram for describing a correlation between an instance of discharge state inspection and a target of discharge state determination.

FIG. 17 is a truth table illustrating an input-output relationship of a decoder.

FIG. 23 is a correlation diagram illustrating a correlation between a determination result signal generated in a discharge state determining unit and the content of comparison.

DESCRIPTION OF EXEMPLARY EMBODIMENTS

An embodiment of a printing apparatus, a control method for the printing apparatus, and a control program for the printing apparatus will be described. The printing apparatus will be described in the present embodiment as an ink jet printer for illustrative purposes. The ink jet printer is included in a printing system and forms a character or the like on a recording paper that is an example of a medium by discharging ink that is an example of liquid.

Summary of Printing System

Figure 1:
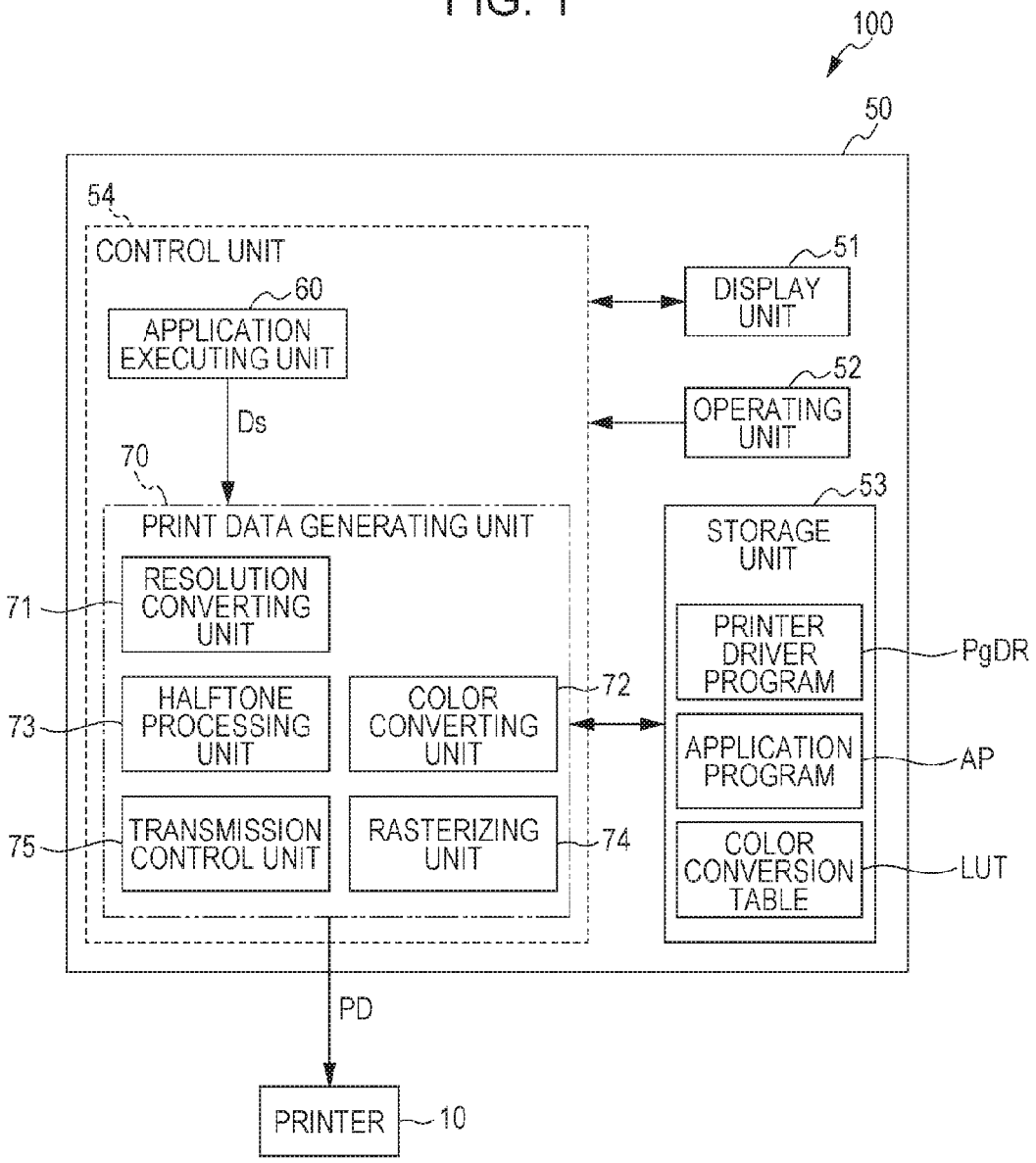
FIG. 1 is a block diagram illustrating a summary of a configuration of a printing system according to an embodiment.

As illustrated in FIG. 1, a printing system 100 includes a printer 10 and a host computer 50. The printer is an ink jet printer, and the host computer 50 communicates with the printer 10. The printer 10 discharges ink to a recording paper to perform a printing process that is the process of forming a print target including a character, a figure, a photograph, and the like. Each process in the present embodiment will be described by assuming that the printer 10 forms a print target in which the ratio of black is high, as in a document or the like.

The host computer 50 is embodied into, for example, a personal computer. The host computer 50 generates print data PD representing a print target and transmits the print data PD to the printer 10.

Configuration of Host Computer

A configuration of the host computer 50 will be described with reference to FIG. 1.

As illustrated in FIG. 1, the host computer 50 includes a display unit 51, an operating unit 52, a storage unit 53, and a control unit 54. The display unit 51 is embodied into a display or the like, and the operating unit 52 is embodied into a keyboard, a mouse, or the like. The storage unit 53 includes a random access memory (RAM), a hard disk drive, and the like, and the control unit 54 includes a CPU.

The storage unit 53 retains a printer driver program PgDR, an application program AP, and a color conversion table LUT. The printer driver program PgDR is a driver program for the printer 10. The application program AP is embodied into document creation software, image editing software, or the like.

The color conversion table LUT is data for converting color space coordinates defined by three primary colors of red, green, and blue (RGB) into color space coordinates defined by one or a plurality of ink colors used by the printer 10 in a printing process. One or a plurality of ink colors used by the printer 10 in a printing process is, for example, the color of four coloring matters (CMYK) of cyan (CY), magenta (MG), yellow (YL), and black (BK).

The control unit 54 includes an application executing unit 60 and a print data generating unit 70.

The application executing unit 60 functions by the control unit 54 executing the application program AP retained by the storage unit 53. For example, when the control unit 54 receives a printing request, the application executing unit 60 outputs target data Ds.

The print data generating unit 70 functions by the control unit 54 executing the printer driver program PgDR retained by the storage unit 53. The print data generating unit 70 converts the target data Ds output from the application executing unit 60 into the print data PD. The print data PD is generated in a format that can be handled by the printer 10. The process of converting the target data Ds into the print data PD is a print data generation process.

The target data Ds, for example, represents the print target with three primary colors of RGB at a resolution appropriate for display performed on the display unit 51. The print data PD, for example, represents the print target with the color of four coloring matters of CMYK at a resolution appropriate for a printing process performed by the printer 10. The print data PD represents the size, arrangement, and the like of dots formed on a recording paper.

The print data generating unit 70 includes a resolution converting unit 71, a color converting unit 72, a halftone processing unit 73, a rasterizing unit 74, and a transmission control unit 75. The resolution converting unit 71 converts a resolution for representing the print target from a resolution appropriate for a display process performed on the display unit 51 to a resolution appropriate for a printing process performed by the printer 10. The color converting unit 72 converts the density of color for representing the print target from the RGB density appropriate for a display process performed on the display unit 51 to the CMYK density appropriate for a printing process performed by the printer 10. The halftone processing unit 73 performs halftone processing that is the process of determining the arrangement, size, and the like of dots so as to represent the print target with dots formed on a recording paper. The rasterizing unit 74 performs rasterization that is the process of linearly arranging the halftone processed data in order of transmission to the printer 10 and generates the print data PD on the basis of the rasterized data. The transmission control unit 75 controls transmission of the print data PD to the printer 10.

The print data generating unit 70 may have the function of setting a printing mode according to the configuration of the print target, in which case the resolution as well as the size, arrangement, and the like of dots are determined according to the set printing mode before generation of the print data PD. Types of printing mode include, for example, a barcode printing mode for printing a barcode on a recording paper, a photograph printing mode for printing a photograph on a recording paper, a figure printing mode for printing a figure on a recording paper, and a normal printing mode for forming an arbitrary target on a recording paper. It is assumed that a general paper such as a document is printed in the normal printing mode. The printing mode may be specified by a user of the printing system 100 or may be set by the print data generating unit 70 according to the target data Ds.

Information that indicates the set printing mode is transmitted to the printer 10 together with the print data PD, and the printer 10 performs a printing process in the set printing mode.

When the printing system 100 has such a configuration, the present embodiment assumes that the normal printing mode is set for a printing process.

Configuration of Printer

A configuration of the printer 10 will be described with reference to FIG. 2 and FIG. 3. The printer 10 of the present embodiment is a printer in which a recording paper moves in one direction while a head unit is fixed.

Figure 2:
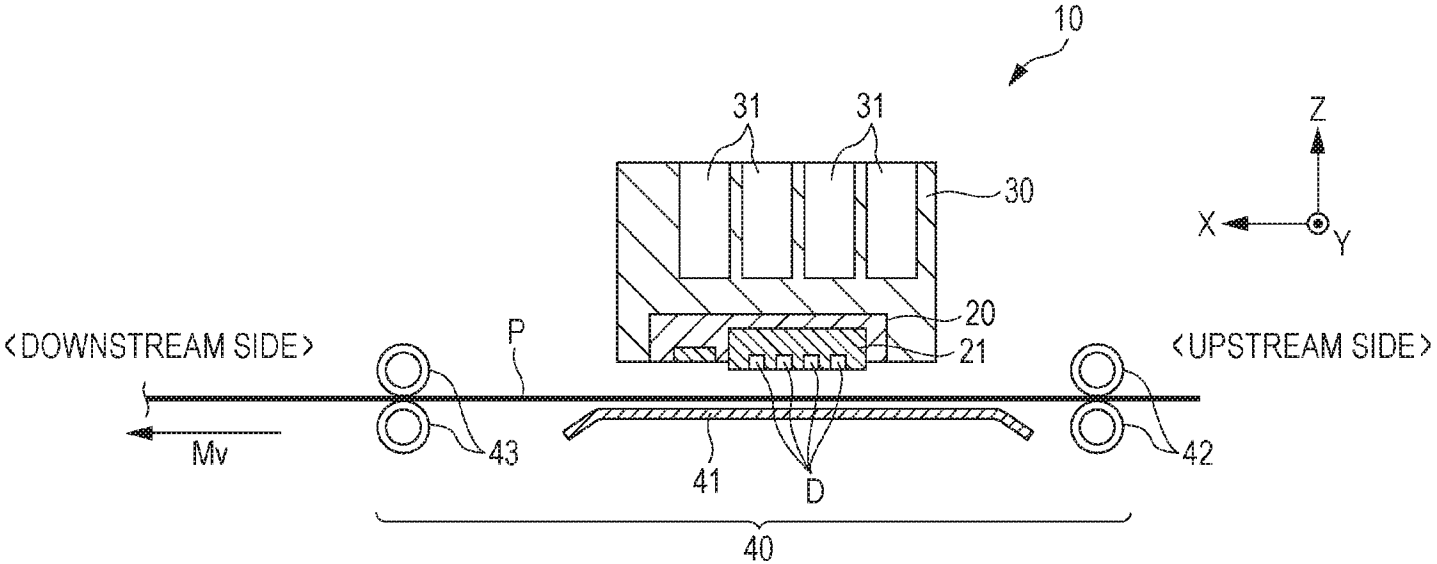
FIG. 2 is a schematic diagram illustrating a schematic configuration of a printer that is an example of a printing apparatus.

As illustrated in FIG. 2, the printer 10 includes a head unit 20 and a transport mechanism 40. The head unit 20 includes a recording head 21 in which a discharging unit D discharging ink is disposed. The transport mechanism 40 changes the position of a recording paper P relative to the head unit 20. The head unit 20 is mounted on a carriage 30. In addition to the head unit 20, there are four ink cartridges 31 mounted on the carriage 30.

The four ink cartridges 31 are disposed in one-to-one correspondence with four colors of black (BK), cyan (CY), magenta (MG), and yellow (YL), and each ink cartridge 31 is filled with ink of color corresponding to the ink cartridge 31. Each ink cartridge 31 may be disposed at another location inside the printer 10 instead of being mounted on the carriage 30.

The transport mechanism 40 includes a platen 41, a transport roller 42, and a discharge roller 43. The platen 41 is disposed under the carriage 30 (−Z direction in FIG. 2). The transport roller 42 is positioned further upstream of the direction of transport than the platen 41 (−X side in FIG. 2). The discharge roller 43 is positioned further downstream of the direction of transport than the platen 41 (+X side in FIG. 2). The transport roller 42 and the discharge roller 43 are configured to be rotatable around the Y axis. The transport roller 42 transports the recording paper P toward the platen 41, and the discharge roller 43 discharges the recording paper P on which printing is performed from the top of the platen 41.

In such a configuration, the recording paper P that is accommodated in an unillustrated accommodation unit is fed toward the transport roller 42 one at a time, and the transport mechanism 40 transports the fed recording paper P from upstream to downstream on a transport path (+X direction in FIG. 2). The transport mechanism 40 transports the recording paper P in the +X direction at a transport speed My while the printer 10 performs a printing process.

A paper detecting sensor that detects the position of the recording paper P is disposed on the transport path of the recording paper P.

A configuration of the printer 10 will be described in detail with focus on an electrical configuration thereof by referring to FIG. 3.

Figure 3:
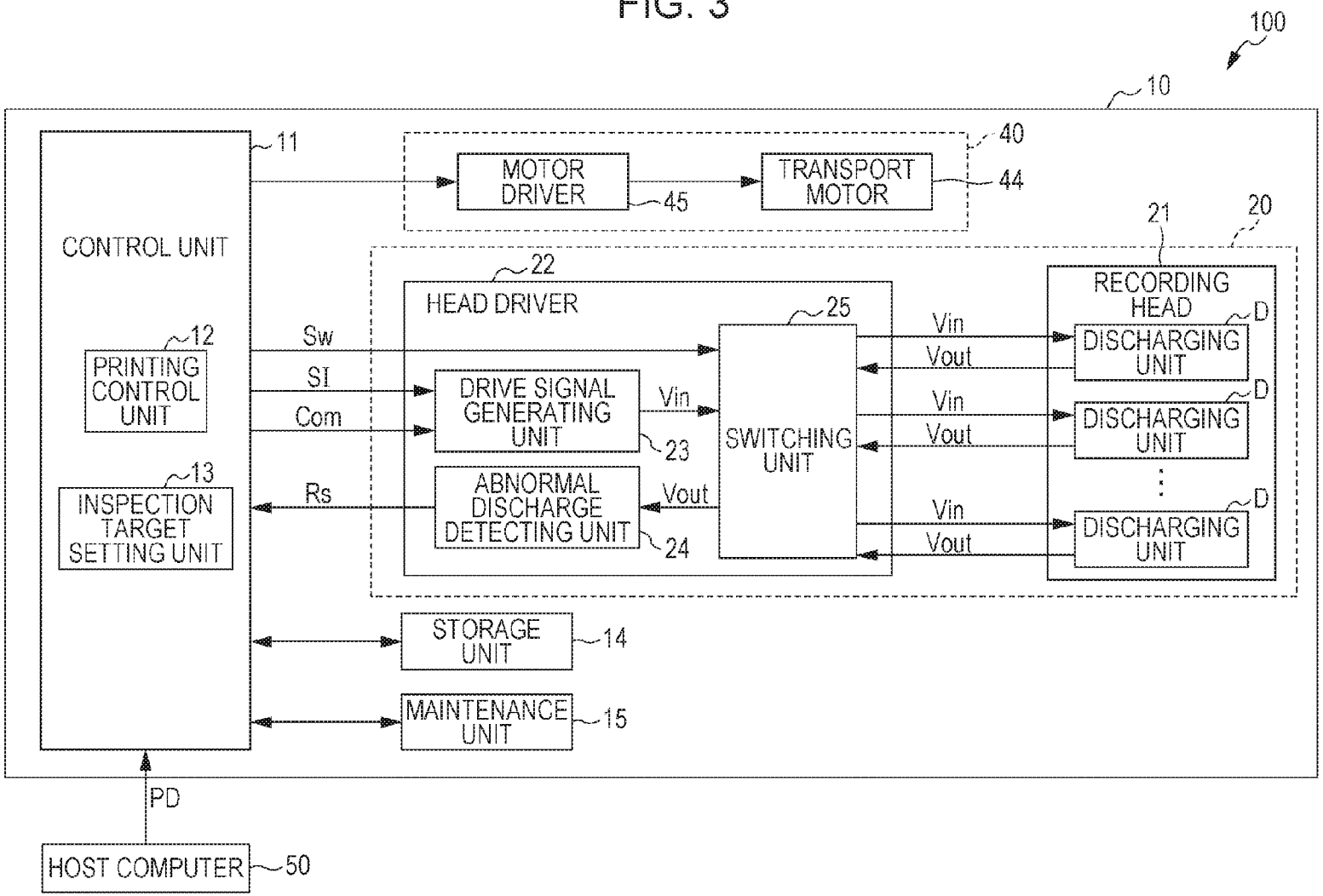
FIG. 3 is a block diagram illustrating a configuration of the printer.

As illustrated in FIG. 3, the printer 10 includes a control unit 11 and a storage unit 14 in addition to the head unit 20 and the transport mechanism 40. The control unit 11 controls operation of each unit of the printer 10. The storage unit 14 retains a control program for the printer 10 and other various types of information. The printer 10 further includes a maintenance unit 15.

The maintenance unit 15 performs a maintenance process when an abnormal discharge occurring in the discharging unit D is detected so as to recover the state of ink discharged from the discharging unit D normally.

An abnormal discharge herein means that the state of ink discharged from a nozzle N (refer to FIG. 4 and FIG. 5 described below) included in the discharging unit D is abnormal. In other words, an abnormal discharge generally refers to the state where the discharging unit D cannot accurately discharge ink from the nozzle N.

More specifically, an abnormal discharge includes the state where the discharging unit D cannot discharge ink as well as the state where the discharging unit D, even if ink can be discharged from the discharging unit D, cannot discharge a necessary amount of ink for forming the print target represented by the print data PD because the amount of ink discharged is small. In addition, an abnormal discharge includes the state where more than a necessary amount of ink for forming the print target represented by the print data PD is discharged from the discharging unit D and the state where the ink discharged from the discharging unit D hits a position different from the position that is supposed to be hit for forming the print target represented by the print data PD.

The maintenance process herein generally refers to processes for returning the state of the discharging unit D discharging ink to normal such as wiping in which a wiper wipes a foreign object such as a paper dust attached near the nozzle N of the discharging unit D, flushing in which ink is preliminarily discharged from the discharging unit D, and pumping in which a tube pump suctions thickened ink, air bubbles, and the like from the discharging unit D.

The transport mechanism 40 includes a transport motor 44 and a motor driver 45 in addition to the configuration previously described with FIG. 3. The transport motor 44 is a drive source for transporting the recording paper P. The motor driver 45 drives the transport motor 44. Transmission of drive power from the transport motor 44 rotationally drives the transport roller 42 as well as the discharge roller 43, thereby transporting the recording paper P.

The storage unit 14 includes an electrically erasable programmable read-only memory (EEPROM) that is one type of non-volatile semiconductor memory storing the print data PD supplied from the host computer 50. The storage unit 14 also includes a RAM that temporarily stores data which is necessary when various processes such as a printing process are performed. Alternatively, a control program for performing various processes such as a printing process is temporarily loaded into the RAM. The storage unit 14 further includes a PROM that is one type of non-volatile semiconductor memory storing a control program for controlling each unit of the printer 10.

The control unit 11 includes, for example, a CPU or a field-programmable gate array (FPGA) and controls operation of each unit of the printer 10 by executing the control program retained by the storage unit 14 with the CPU or the like.

Specifically, the control unit 11 includes a printing control unit 12 as well as an inspection target setting unit 13 that is an example of a setting unit and controls performance of various processes such as a printing process, a complementation process, a complementation possibility determination process, a discharge state determination process, an inspection target setting process, and the above maintenance process and the like.

More specifically, the control unit 11 controls performance of the printing process of forming the print target according to the print data PD on the recording paper P by controlling the head unit 20 as well as the transport mechanism 40 on the basis of the print data PD and the like supplied from the host computer 50.

Specifically, first, the control unit 11 stores the print data PD supplied from the host computer 50 in the storage unit 14. Next, the control unit 11 generates a signal for controlling operation of the head unit 20 or a signal for driving the discharging unit D on the basis of various types of data stored in the storage unit 14 such as the print data PD. Signals generated by the control unit 11 include a printing signal SI and a drive waveform signal Com. There are three types of drive waveform signal Com according to the present embodiment including drive waveform signals Com-A, Com-B, and Com-C. Details of these signals will be described below.

The control unit 11 generates signals for controlling operation of the motor driver 45 on the basis of the printing signal SI or various types of data stored in the storage unit 14 and outputs various types of signal generated.

As such, the control unit 11 controls whether to discharge ink from the discharging unit D, the amount of ink discharged, the timing of discharging ink, and the like by controlling the head unit 20 and drives the transport motor in such a manner that the recording paper P is transported in the +X direction by controlling the motor driver 45. Accordingly, the control unit 11 adjusts the size and arrangement of dots formed by ink discharged on the recording paper P and controls performance of the printing process of forming the print target corresponding to the print data PD on the recording paper P.

A complementation process is the process of complementing one discharging unit D with another discharging unit D different from the one discharging unit D when an abnormal discharge occurs in the one discharging unit D. More specifically, a complementation process is the process of complementing one discharging unit D with another discharging unit D (switching the role of one discharging unit D and another discharging unit D) when an abnormal discharge occurs in one discharging unit D, by increasing the amount of ink discharged from another discharging unit D different from the one discharging unit D instead of discharging ink from the one discharging unit D. The control unit 11 controls operation of each unit of the printer 10 to perform the complementation process. Accordingly, it is possible to continue the printing process without stopping the printing process to perform the maintenance process even if an abnormal discharge occurs.

Hereinafter, complementing one discharging unit D including one nozzle N with another discharging unit D including another nozzle N will be referred to as "complementing one nozzle N with another nozzle N" as well.

The meaning of "increasing the amount of ink discharged from another discharging unit D" in the case of complementing one discharging unit D with another discharging unit D obviously includes the case where another discharging unit D that is not supposed to discharge ink when the complementation process is not performed discharges ink by performing the complementation process.

A complementation possibility determination process is the process of determining whether another discharging unit D can complement one discharging unit D in the case of complementing one discharging unit D with another discharging unit D. In other words, a complementation possibility determination process is the process of determining whether the discharge state of another discharging unit D is normal and whether ink can be normally discharged from the other discharging unit D. That is, the complementation possibility determination process is performed when the complementation process is performed.

A discharge state determination process is the process of determining whether ink can be normally discharged from the discharging unit D by using residual vibration occurring in the discharging unit D.

An inspection target setting process is the process of setting the discharging unit D that is the target of determination of a discharge state. The storage unit 14 retains data that defines the order of inspection for a plurality of discharging units D, and the control unit 11 sets the discharging unit D that is the target of determination of a discharge state on the basis of the data retained by the storage unit 14 each time the discharge state determination process is performed between printing processes.

The control unit 11 functions as the printing control unit 12 by performing a part or all of the printing process, the complementation process, the complementation possibility determination process, and the discharge state determination process. In addition, the control unit 11 functions as the inspection target setting unit 13 by performing the inspection target setting process.

Next, a detailed configuration of the head unit 20 will be described. The head unit 20 includes the above recording head 21 including 8M (M is a natural number greater than or equal to two) discharging units D and a head driver 22. The head driver 22 drives each discharging unit D included in the recording head 21 and detects an abnormal discharge of each discharging unit D. Hereinafter, in order to distinguish the 8M discharging units D from each other, these discharging units D may be referred to as first stage, second stage, . . . , 8M-th stage discharging units D in order from one end thereof.

Each of the 8M discharging units D receives supply of ink from one of the four ink cartridges 31. Each discharging unit D is filled with the ink supplied from the ink cartridge 31 and is capable of discharging the ink filling the discharging unit D from the nozzle N included in the discharging unit D. Then, each discharging unit D forms the print target on the recording paper P by discharging ink to the recording paper P at the timing of transporting the recording paper P with the transport mechanism 40 onto the platen 41. Accordingly, full color printing is realized because four color ink of CMYK can be discharged as a whole from the 8M discharging units D.

The head driver 22 includes a drive signal generating unit 23, an abnormal discharge detecting unit 24, and a switching unit 25.

The drive signal generating unit 23 generates a drive signal Vin for driving each of the 8M discharging units D included in the recording head 21 on the basis of the printing signal SI, the drive waveform signal Com, and the like supplied from the control unit 11. Each discharging unit D, when supplied with the drive signal Vin, is driven on the basis of the supplied drive signal Vin and is capable of discharging ink filling therein to the recording paper P.

The abnormal discharge detecting unit 24 detects a pressure change inside the discharging unit D as a residual vibration signal Vout. The ink inside the discharging unit D vibrates after the discharging unit D is driven by the drive signal Vin, and the pressure inside the discharging unit D changes following such vibration or the like of ink. Then, the abnormal discharge detecting unit 24 determines the state of ink discharged from the discharging unit D on the basis of the detected residual vibration signal Vout, such as whether there is an abnormal discharge in the discharging unit D, and outputs a determination result signal Rs that represents the determination result. As such, the abnormal discharge detecting unit 24 functions as a residual vibration detecting unit as well as a discharge state determining unit.

The frequency of detection of the residual vibration signal Vout from one discharging unit D indicates the frequency of determination of the state of ink discharged from the nozzle N of the discharging unit D, that is, the frequency of the discharge state inspection. When the frequency of detection of the residual vibration signal Vout from one discharging unit D is high, this indicates that the frequency of the discharge state inspection of the discharging unit D is high. That is, the discharge state inspection is frequently performed on the discharging unit D. Meanwhile, when the frequency of detection of the residual vibration signal Vout from one discharging unit D is low, this indicates that the frequency of the discharge state inspection of the discharging unit D is low. That is, the discharge state inspection is rarely performed on the discharging unit D.

The switching unit 25 connects each discharging unit D electrically to one of the drive signal generating unit 23 and the abnormal discharge detecting unit 24 on the basis of a switching control signal Sw supplied from the control unit 11.

Configuration of Recording Head

Configurations of the recording head 21 and the discharging unit D disposed in the recording head 21 will be described with reference to FIG. 4 and FIG. 5.

Figure 4:
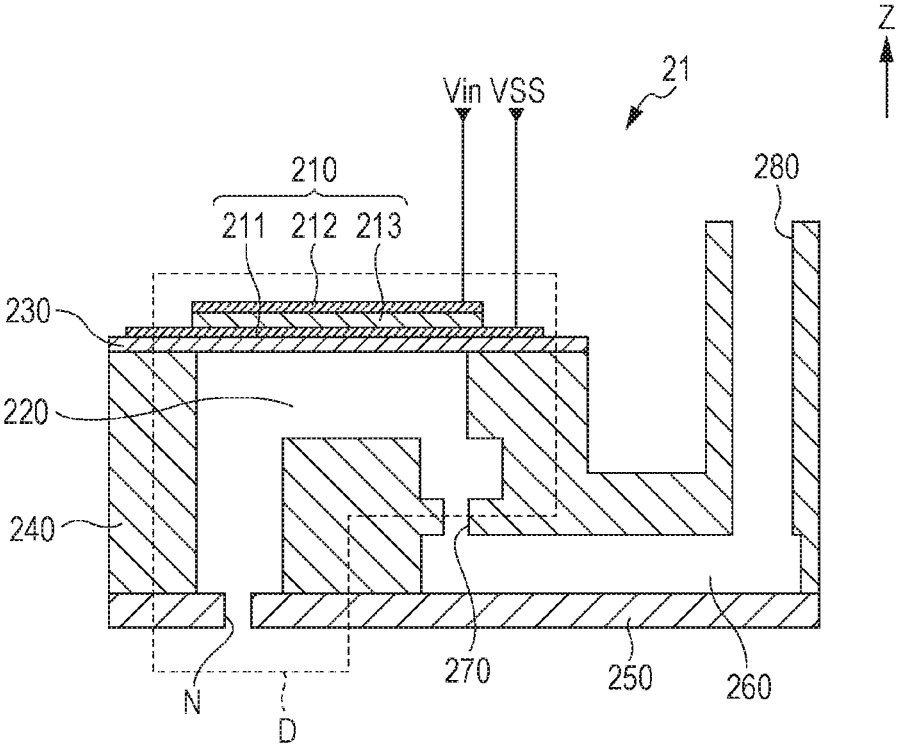
FIG. 4 is a sectional view illustrating a schematic configuration of a recording head.

FIG. 4 is an example of a schematic partial sectional view of the recording head 21. For convenience of illustration, FIG. 4 illustrates one discharging unit D of the 8M discharging units D included in the recording head 21, a reservoir 260, and an ink intake port 280 in the recording head 21. The reservoir 260 communicates with the one discharging unit D through an ink supply port 270. The ink intake port 280 supplies ink from the ink cartridge 31 to the reservoir 260.

As illustrated in FIG. 4, the discharging unit D includes a piezoelectric element 210, a cavity 220 filled with ink, the nozzle N communicating with the cavity 220, and a vibrating plate 230. The discharging unit D discharges the ink of the cavity 220 from the nozzle N when the piezoelectric element 210 is driven by the drive signal Vin.

The cavity 220 of the discharging unit D is a space that is defined by a cavity plate 240 formed into a predetermined shape such as having a recessed portion, a nozzle plate 250 in which the nozzle N is formed, and the vibrating plate 230. The cavity 220 communicates with the reservoir 260 through the ink supply port 270. The reservoir 260 communicates with one ink cartridge 31 through the ink intake port 280.

A unimorph (monmorph) element as illustrated in FIG. 4, for example, is employed as the piezoelectric element 210 in the present embodiment. The piezoelectric element 210 includes a lower electrode 211, an upper electrode 212, and a piezoelectric body 213 disposed between the lower electrode 211 and the upper electrode 212. When voltage is applied between the lower electrode 211 and the upper electrode 212 by setting the lower electrode 211 to a predetermined reference potential VSS and supplying the drive signal Vin to the upper electrode 212, the piezoelectric element 210 bends upward and downward in FIG. 4 in response to the applied voltage. As a consequence, the piezoelectric element 210 vibrates.

The vibrating plate 230 is installed in an upper face opening portion of the cavity plate 240, and the lower electrode 211 is bonded to the vibrating plate 230. Thus, when the piezoelectric element 210 vibrates because of the drive signal Vin, the vibrating plate 230 vibrates as well. Then, the vibration of the vibrating plate 230 changes the volume of the cavity 220 (pressure inside the cavity 220), and the ink filling the cavity 220 is discharged from the nozzle N.

Ink is supplied from the reservoir 260 when the amount of ink inside the cavity 220 is decreased by discharge of ink. Ink is supplied to the reservoir 260 from the ink cartridge 31 through the ink intake port 280.

Figure 5:
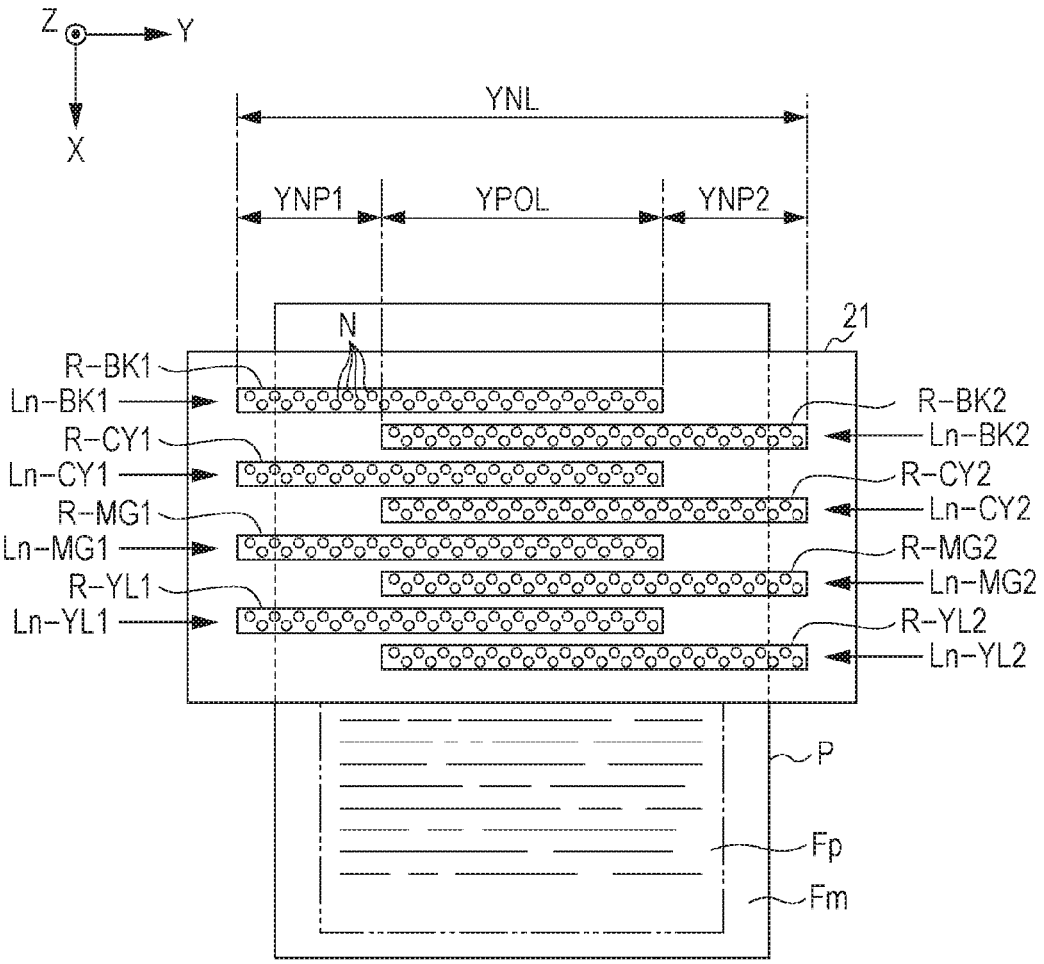
FIG. 5 is a plan view illustrating an example of arrangement of nozzles in the recording head.

FIG. 5 is a diagram illustrating an example of arrangement of 8M nozzles N disposed in the recording head when the printer 10 is viewed from either the +Z direction or the −Z direction. Hereinafter, a view of the printer 10 from the +Z direction or the −Z direction will be referred to as "plan view".

As illustrated in FIG. 5, eight nozzle arrays Ln (Ln-BK1 to Ln-YL2) are disposed in the recording head 21. The nozzle arrays Ln include a nozzle array Ln-BK1 configured of M nozzles N arranged in a nozzle formed region R-BK1 and a nozzle array Ln-BK2 configured of M nozzles N arranged in a nozzle formed region R-BK2. In addition, the nozzle arrays Ln include a nozzle array Ln-CY1 configured of M nozzles N arranged in a nozzle formed region R-CY1 and a nozzle array Ln-CY2 configured of M nozzles N arranged in a nozzle formed region R-CY2. In addition, the nozzle arrays Ln include a nozzle array Ln-MG1 configured of M nozzles N arranged in a nozzle formed region R-MG1 and a nozzle array Ln-MG2 configured of M nozzles N arranged in a nozzle formed region R-MG2. Furthermore, the nozzle arrays Ln include a nozzle array Ln-YL1 configured of M nozzles N arranged in a nozzle formed region R-YL1 and a nozzle array Ln-YL2 configured of M nozzles N arranged in a nozzle formed region R-YL2. Hereinafter, the nozzle formed regions R-BK1 to R-YL2 may be simply referred to as "regions R-BK1 to R-YL2".

Each of the eight regions R-BK1 to R-YL2 is an imaginary region having a shape of an oblong that is defined by long edges extending in the Y-axis direction and short edges extending in the X-axis direction in a plan view.

More specifically, the regions R-BK1, R-CY1, R-MG1, and R-YL1 are disposed to extend within a range YNP1 and a range YPOL in the Y-axis direction. In addition, the regions R-BK2, R-CY2, R-MG2, and R-YL2 are disposed to extend within the range YPOL and a range YNP2 in the Y-axis direction.

The positions of these eight regions R-BK1 to R-YL2 are different from each other in the X-axis direction. The regions R-BK1 to R-YL2 are linearly arranged in the order of R-BK1, R-BK2, R-CY1, R-CY2, R-MG1, R-MG2, R-YL1, and R-YL2 from the −X side (upstream side) to the +X side (downstream side) of FIG. 5.

That is, the eight regions R-BK1 to R-YL2 are linearly arranged in the X-axis direction in the range YPOL, the four regions R-BK1, R-CY1, R-MG1, and R-YL1 are linearly arranged in the range YNP1, and the four regions R-BK2, R-CY2, R-MG2, and R-YL2 are linearly arranged in the range YNP2.

Each of the 2M nozzles N belonging to the nozzle arrays Ln-BK1 and Ln-BK2 is the nozzle N that is disposed in the discharging unit D discharging black (BK) ink. Each of the 2M nozzles N belonging to the nozzle arrays Ln-CY1 and Ln-CY2 is the nozzle N that is disposed in the discharging unit D discharging cyan (CY) ink. Each of the 2M nozzles N belonging to the nozzle arrays Ln-MG1 and Ln-MG2 is the nozzle N that is disposed in the discharging unit D discharging magenta (MG) ink. Each of the 2M nozzles N belonging to the nozzle arrays Ln-YL1 and Ln-YL2 is the nozzle N that is disposed in the discharging unit D discharging yellow (YL) ink.

The M nozzles N constituting each nozzle array Ln are arranged in a so-called zigzag form in such a manner that the positions of the even nozzles N are different from the positions of the odd nozzles N in the X-axis direction from the left (−Y side) of FIG. 5 The interval (pitch) between the nozzles N of each nozzle array Ln in the Y-axis direction may be appropriately set according to a printing resolution (dot per inch, dpi).

As described above, the printer 10 is a printer that performs printing from the fixed recording head 21 on the recording paper P transported in the +X direction. Thus, the range in which the 8M nozzles N are disposed in the Y-axis direction (that is, a range YNL configured of the range YNP1, the range YPOL, and the range YNP2) is longer than or equal to the width of the recording paper P in the Y-axis direction (exactly, the maximum region of the recording paper P where the printer 10 can perform printing).

Each nozzle N positioned within the range YPOL of the M nozzles N belonging to each nozzle array Ln is referred to as "overlapping nozzle". One nozzle N is called an overlapping nozzle if there exists another nozzle N that discharges the same color ink and is positioned at approximately the same position as the one nozzle N in the Y-axis direction in the nozzle array Ln which is different from the nozzle array Ln to which the overlapping nozzle belongs to. The expression "approximately the same" in the present specification includes the case where two things are regarded as the same when various types of error such as a manufacturing error and an error caused by noise or the like are taken into consideration, in addition to the case where two things are completely the same.

In the printing process of the present embodiment, the region of the recording paper P is divided into a printing region Fp and a marginal region Fm surrounding the printing region Fp, and the recording head 21 forms the print target in the printing region Fp.

Operation of Discharging Unit and Residual Vibration

An ink discharging operation of discharging ink from the discharging unit D and residual vibration occurring in the discharging unit D will be described with reference to FIG. 6A to FIG. 14.

Figure 6A:
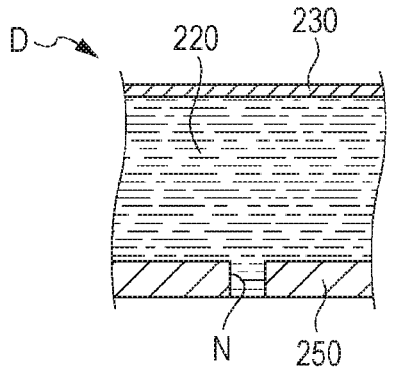
FIGS. 6A to 6C are sectional views for describing a change in the sectional shape of a discharging unit when a drive signal is supplied.

FIG. 6A illustrates the initial state of the discharging unit D. The head driver 22 applies the drive signal Vin to the piezoelectric element 210 that the discharging unit D in the initial state includes.

Figure 6B:
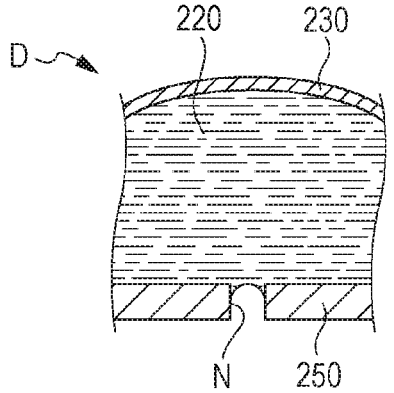

FIG. 6B illustrates the state of the discharging unit D to which the drive signal Vin for exerting strain on the piezoelectric element 210 is applied. Strain occurs in the piezoelectric element 210 to which the drive signal Vin is applied in response to the voltage applied between the electrodes. The vibrating plate 230 bonded to the piezoelectric element 210 in which strain occurs bends upward. Accordingly, the volume of the cavity 220 of the discharging unit D increases from the initial state.

Figure 6C:
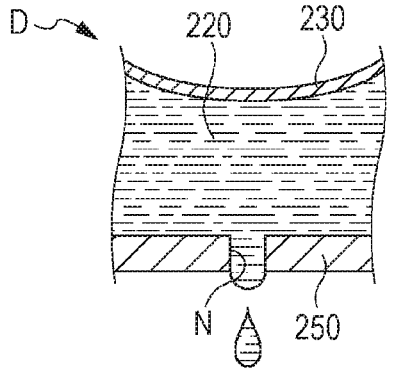

FIG. 6C illustrates the state of the discharging unit D to which the drive signal Vin for removing strain from the piezoelectric element 210 is applied. In the discharging unit D to which the drive signal Vin for removing strain from the piezoelectric element 210 is applied, elastic restoring force of the vibrating plate 230 moves the vibrating plate 230 downward from the initial state, and the volume of the cavity 220 decreases rapidly. Compressive pressure occurring in the cavity 220 causes part of the ink filling the cavity 220 to be discharged as an ink drop from the nozzle N that communicates with the cavity 220.

The vibration of the vibrating plate 230 is damped after the series of processes of the ink discharging operation ends until the subsequent ink discharging operation starts. That is, residual vibration occurs in the vibrating plate 230. The residual vibration of the vibrating plate 230 is assumed to have a natural vibration frequency that is determined by an acoustic resistance r, an inertance m, and a compliance Cm of the vibrating plate 230. The acoustic resistance r depends on the shape of the nozzle N or of the ink supply port 270, the viscosity of ink, or the like. The inertance m depends on the weight of ink in a channel.

A calculation model for the residual vibration of the vibrating plate 230 based on the above assumption will be described.

Figure 7:
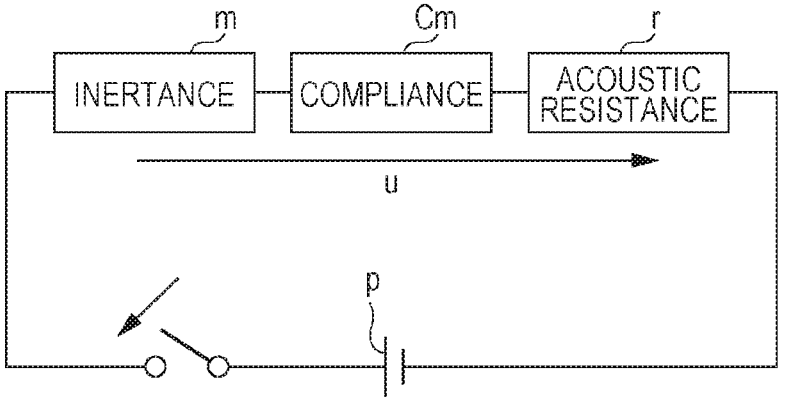
FIG. 7 is a circuit diagram illustrating a simple harmonic vibration model representing residual vibration in the discharging unit.

FIG. 7 is a circuit diagram illustrating a simple harmonic vibration calculation model that assumes the residual vibration of the vibrating plate 230. As illustrated in FIG. 7, the calculation model for the residual vibration of the vibrating plate 230 can be represented by an acoustic pressure p and the inertance m, the compliance Cm, and the acoustic resistance r described above. The following expressions are obtained by calculating a step response with respect to a volume velocity u at the time of applying the acoustic pressure p to the circuit illustrated in FIG. 7.

$$u=\{p/(\omega\cdot m)\}e^{-\sigma t}\cdot\sin(\omega t)$$

$$\omega=\{1/(m\cdot Cm)-\alpha^2\}^{1/2}$$

$$\sigma=r/(2m)$$

The result of calculation obtained from the expressions (calculated value) and the result of an experiment that is separately performed on the residual vibration of the discharging unit D (experimental value) are compared. The experiment performed on the residual vibration is an experiment that detects residual vibration occurring in the vibrating plate 230 of the discharging unit D after ink is discharged from the discharging unit D which discharges ink normally.

Figure 8:
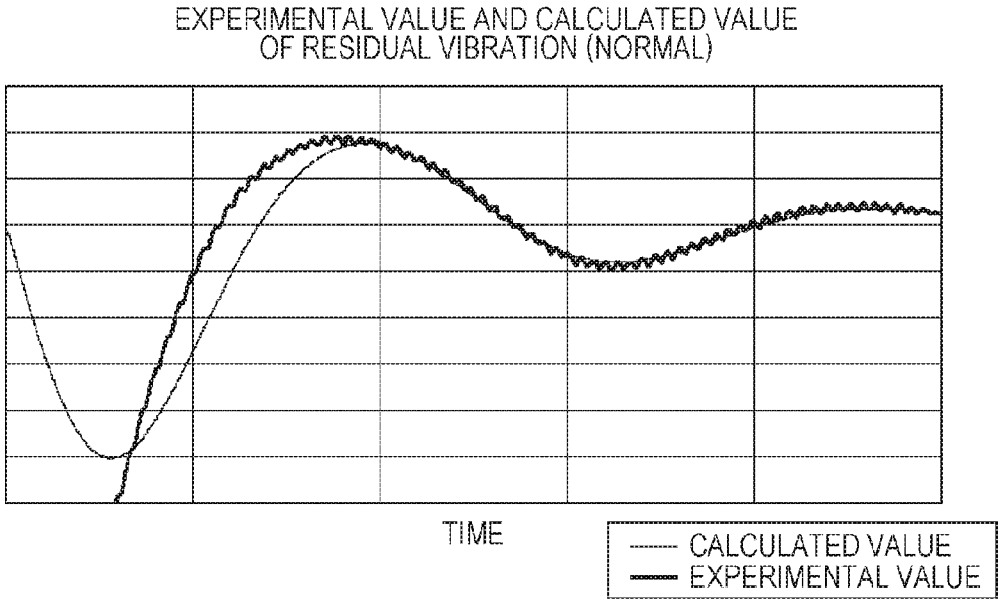
FIG. 8 is a graph illustrating an experimental value and a calculated value of residual vibration in a correlation of amplitude to time when the discharge state of the discharging unit is normal.

FIG. 8 is a graph illustrating the experimental value and the calculated value of the residual vibration in a correlation of amplitude to time. As illustrated in FIG. 8, when the state of ink discharged from the discharging unit D is normal, the two waveforms of the experimental value and the calculated value approximately match each other.

The nozzle N of the discharging unit D does not normally discharge an ink drop when the discharging unit D of which the discharge state is abnormal performs the ink discharging operation. Examples of the cause of such an abnormal discharge include mingling of an air bubble in the cavity 220, thickening or solidification of ink inside the cavity 220 due to drying and the like of ink inside the cavity 220, and attachment of paper dust near the outlet of the nozzle N.

An abnormal discharge typically means that ink cannot be discharged from the nozzle N. That is, a phenomenon in which ink is not discharged occurs, in which case dots are omitted at pixels in the print target printed on the recording paper P. In addition, an abnormal discharge means that even if ink is discharged from the nozzle N, either the amount of ink is excessively small or the direction of flight of the discharged ink drop shifts from the correct direction, thereby omitting dots at pixels. Hereinafter, an abnormal discharge will be simply referred to as "dot omission" in the description.

In the description below, at least the smaller value of the acoustic resistance r and the inertance m is adjusted on the basis of the comparison result illustrated in FIG. 8 in such a manner that the calculated value and the experimental value of the residual vibration in a correlation of amplitude to time approximately match each other for each cause of an abnormal discharge occurring in the discharging unit D.

Figure 9:
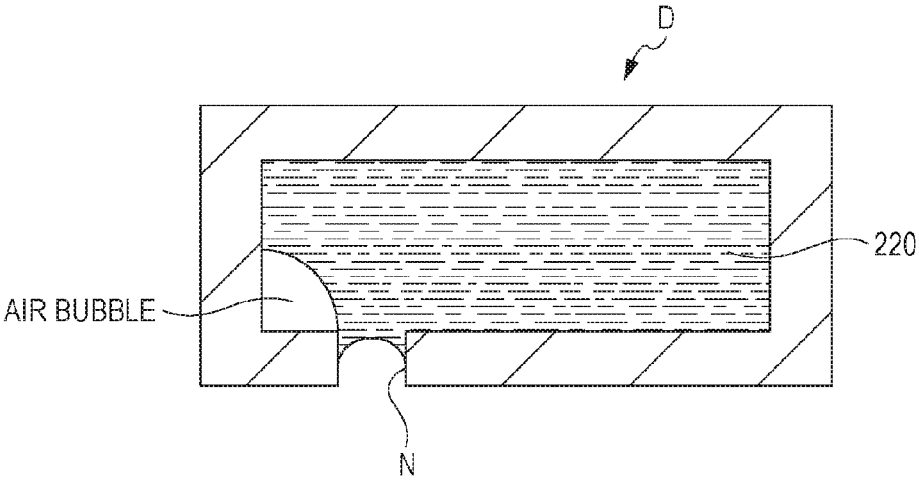
FIG. 9 is a sectional view illustrating the state of the discharging unit when an air bubble mingles in the discharging unit.

First, mingling of an air bubble in the cavity 220 which is one of the causes of an abnormal discharge will be reviewed. FIG. 9 illustrates an example of the discharging unit D in which an air bubble mingles in the cavity 220.

Figure 10:
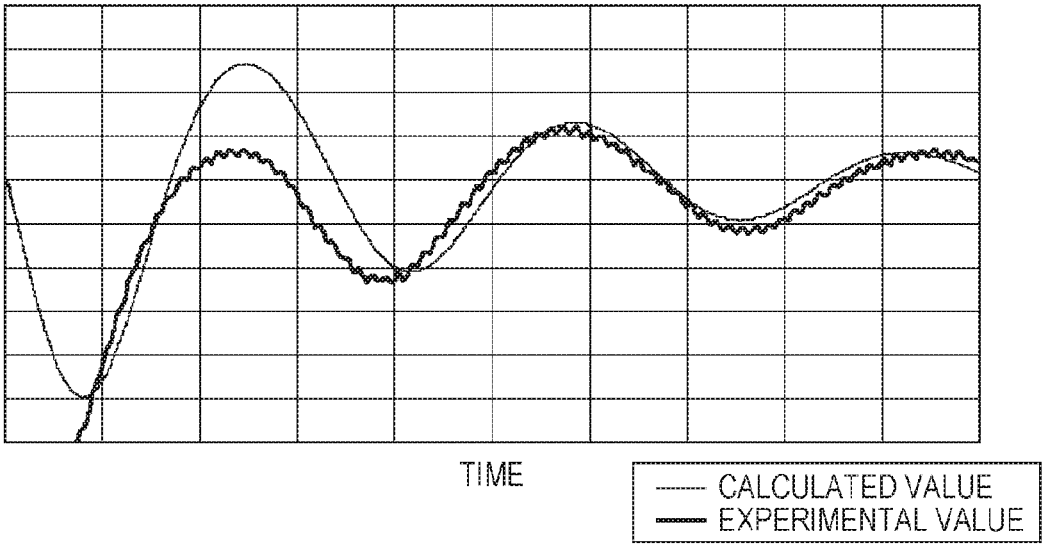
FIG. 10 is a graph illustrating an experimental value and a calculated value of residual vibration in the state where an air bubble mingles in the discharging unit.

As illustrated in FIG. 9, when an air bubble mingles in the cavity 220, the total weight of the ink filling the cavity 220 decreases, and the inertance m is considered to be decreased. In addition, as illustrated in FIG. 9, when an air bubble is attached near the nozzle N, the diameter of the nozzle N is regarded as being increased by the size of the diameter of the air bubble, and the acoustic resistance r is considered to be decreased. These considerations are supported by the fact that the calculated value and the experimental value match each other in a calculation where the acoustic resistance r and the inertance m are set to be decreased from those in the normal state of discharge of ink as illustrated in FIG. 10.

When an abnormal discharge occurs because of an air bubble mingling in the cavity 220, the frequency of the residual vibration increases in comparison with the case of the normal discharge state. The damping ratio of the amplitude of the residual vibration is decreased by a decrease in the acoustic resistance r or the like, and the amplitude of the residual vibration decreases slowly.

Figure 11:
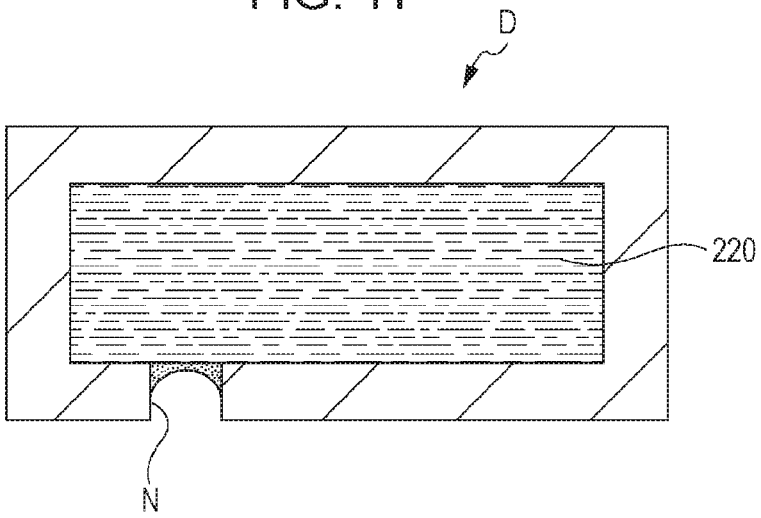
FIG. 11 is a sectional view illustrating the state of the discharging unit when ink solidifies near the nozzle.

Next, thickening or solidification of ink inside the cavity 220 which is one of the causes of an abnormal discharge will be reviewed. FIG. 11 illustrates an example of the discharging unit D in which ink solidifies near the nozzle N.

Figure 12:
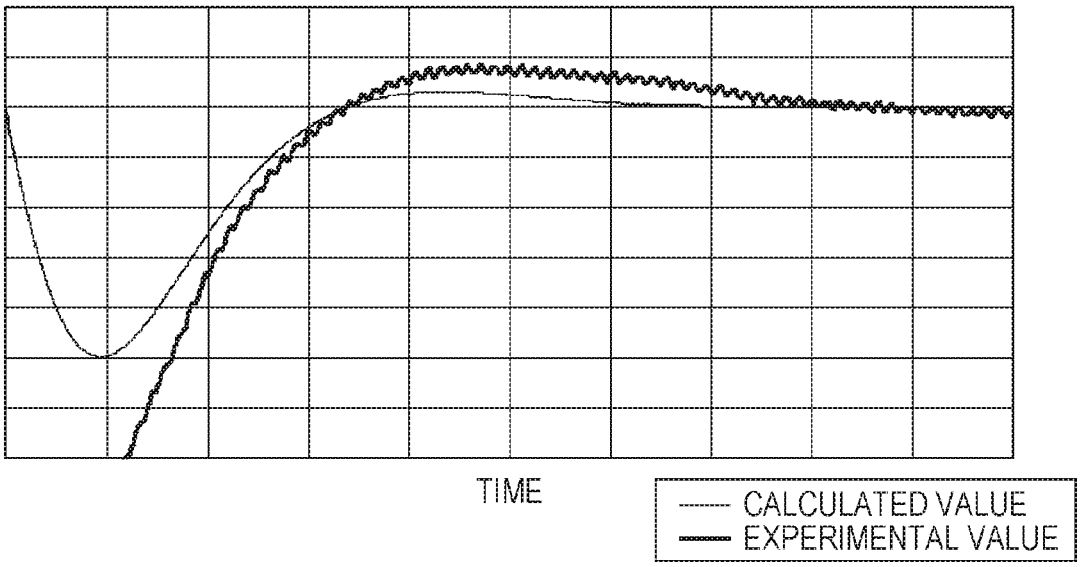
FIG. 12 is a graph illustrating an experimental value and a calculated value of residual vibration in the state where ink cannot be discharged because of solidification of ink near the nozzle.

As illustrated in FIG. 11, when ink dries and solidifies near the nozzle N, the ink inside the cavity 220 is confined to the inside of the cavity 220. In such a case, the acoustic resistance r is considered to be increased. This consideration is supported by the fact that the calculated value and the experimental value match each other in a calculation where the acoustic resistance r is set to be increased from that in the normal state of discharge of ink as illustrated in FIG. 12. The experimental value illustrated in FIG. 12 is the result of measuring the residual vibration of the vibrating plate 230 in the state where ink solidifies near the nozzle N after the discharging unit D is left for several days without mounting a cap (not illustrated) thereon. When ink solidifies near the nozzle N, the frequency of the residual vibration extremely decreases in comparison with the case of the normal discharge state, and a characteristic overdamped waveform of the residual vibration is obtained. The reason is that when the vibrating plate 230 attracted in the +Z direction (upward) to discharge ink causes ink to flow into the cavity 220 from the reservoir and the vibrating plate 230 moves in the −Z direction (downward), there is no way for the ink inside the cavity 220 to escape, and the vibrating plate 230 suddenly cannot vibrate (overdamped).

Figure 13:
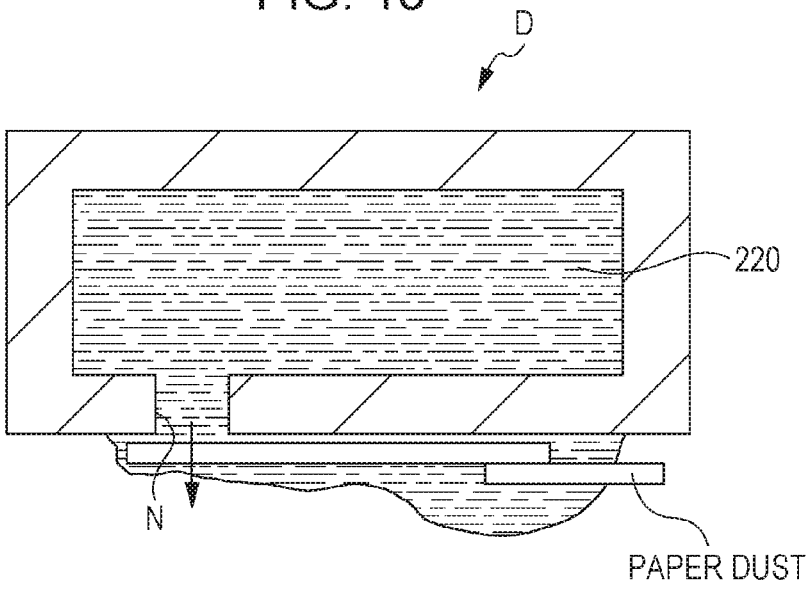
FIG. 13 is a sectional view illustrating the state of the discharging unit when paper dust is attached near the outlet of the nozzle.

Next, attachment of paper dust near the outlet of the nozzle N which is one of the causes of an abnormal discharge will be reviewed. FIG. 13 illustrates an example of the discharging unit D in which paper dust is attached near the outlet of the nozzle N.

Figure 14:
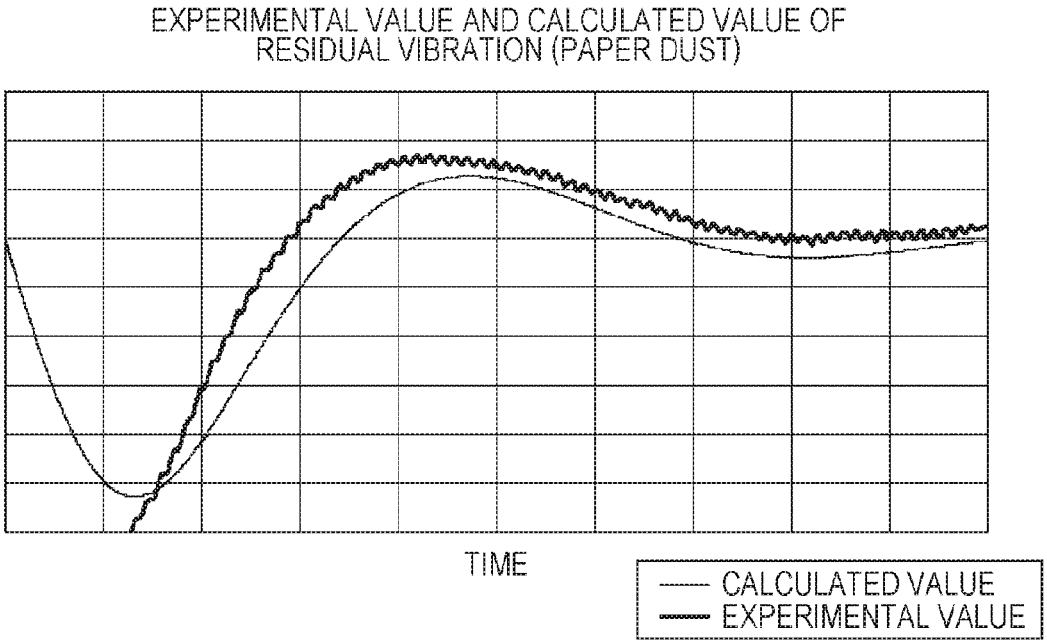
FIG. 14 is a graph illustrating an experimental value and a calculated value of residual vibration in the state where ink cannot be discharged because of paper dust attached near the outlet of the nozzle.

As illustrated in FIG. 13, when paper dust is attached near the outlet of the nozzle N, ink oozes from the cavity 220 through the paper dust, and ink cannot be discharged from the nozzle N. When paper dust is attached near the outlet of the nozzle N and ink oozes from the nozzle N, the amount of ink is increased from that in the case of the normal discharge state by the amount of ink oozing from the cavity 220 when viewed from the vibrating plate 230, and the inertance m is considered to be increased. In addition, the acoustic resistance r is considered to be increased because of the fibers of the paper dust attached near the outlet of the nozzle N. These considerations are supported by the face that the calculated value and the experimental value match each other in a calculation where the inertance m and the acoustic resistance r are set to be increased from those in the normal state of discharge of ink as illustrated in FIG. 14. In addition, when paper dust is attached near the outlet of the nozzle N, the frequency of the residual vibration decreases in comparison with the case of the normal discharge state.

It is understood from the graphs illustrated in FIG. 12 and FIG. 14 that when paper dust is attached near the outlet of the nozzle N, the frequency of the residual vibration increases in comparison with the case where ink is thickened inside the cavity 220.

Either when ink is thickened or when paper dust is attached near the outlet of the nozzle N, the frequency of the residual vibration decreases in comparison with the case of the normal state of discharge of ink. These two causes of an abnormal discharge can be distinguished from each other by comparing the waveform of the residual vibration, or specifically, the frequency or cycle of the residual vibration with a predetermined threshold.

It is apparent from the above description that the discharge state of each discharging unit D can be determined on the basis of the waveform of the residual vibration, or particularly, the frequency or cycle of the residual vibration occurring when each discharging unit D is driven. More specifically, it is possible to determine whether the discharge state of each discharging unit D is normal and to determine which one of the above three causes is the cause of an abnormal discharge when the abnormal discharge occurs in each discharging unit D, on the basis of the frequency or cycle of the residual vibration.

The printer 10 of the present embodiment performs the above discharge state determination process as the process of determining a discharge state by analyzing the residual vibration.

Discharging Unit Inspection Order

The order of inspection of the discharging units D set by the inspection target setting process of the control unit 11 will be described with reference to FIG. 15.

In the present embodiment, the discharge state determination process is performed after the recording paper P on which printing is completed starts to be discharged from the top of the platen 41 until the recording paper P on which printing is to be subsequently performed is positioned at an initial position on the platen 41. The position of the recording paper P is detected by the paper detecting sensor disposed on the transport path of the recording paper P or on the basis of the state of the transport motor 44 driven or the like. Hereinafter, the period between the start of discharge of the recording paper P on which printing is completed and arrangement of a new recording paper P at the initial position will be referred to as a paper exchange period.

The discharge state determination process is performed in each paper exchange period while printing is performed in order on a plurality of recording papers P. Given that the discharge state determination process performed in one paper exchange period is regarded as one instance of the discharge state inspection, a part of the 8M discharging units D is set as the target of inspection, that is, the target of the discharge state determination process in one instance of the discharge state inspection. The inspection target discharging unit D changes each time one instance of the discharge state inspection is performed.

Specifically, the control unit 11 sets the discharging unit D discharging one of the four color ink as the inspection target in one instance of the discharge state inspection. In addition, the control unit 11 sets the frequency of inspection of the discharging unit D discharging black ink to be higher than the frequency of inspection of each discharging unit D discharging each of cyan, magenta, and yellow ink.

Hereinafter, a specific example will be described of the order of inspection of the discharging units D. In the description below, the discharging unit D discharging black ink will be referred to as the discharging unit D belonging to black, and the discharging unit D discharging cyan ink will be referred to as the discharging unit D belonging to cyan. In addition, the discharging unit D discharging magenta ink will be referred to as the discharging unit D belonging to magenta, and the discharging unit D discharging yellow ink will be referred to as the discharging unit D belonging to yellow.

As illustrated in FIG. 15, the control unit 11 sets one color to which the inspection target belongs to in one instance of the discharge state inspection and changes the color of ink to which the inspection target belongs to in order in each instance of the discharge state inspection. The order of changing the color of ink to which the inspection target belongs is set as "black→cyan→black→magenta→black→yellow→black→cyan→ . . . " in such a manner that black alternates with one of three colors other than black and that each of cyan, magenta, and yellow is repeated in order with black interposed therebetween.

That is, when the color to which the discharging unit D that is the target of the k-th (k is a natural number) discharge state inspection belongs to is black, the discharging unit D belonging to cyan becomes the inspection target in the (k+1)-th discharge state inspection, and the discharging unit D belonging to black again becomes the inspection target in the (k+2)-th discharge state inspection. The discharging unit D belonging to magenta becomes the inspection target in the (k+3)-th discharge state inspection, and the discharging unit D belonging to black again becomes the inspection target in the (k+4)-th discharge state inspection. The discharging unit D belonging to yellow becomes the inspection target in the (k+5)-th discharge state inspection, and from the (k+6)-th discharge state inspection, the color to which the inspection target belongs changes in the same order as the order of inspection from k to k+5.

When the discharging unit D belonging to black is set as the inspection target, the discharging unit D that corresponds to each of the 2M nozzles N belonging to the nozzle arrays Ln-BK1 and the Ln-BK2 is set as the target of the discharge state determination process. When the discharging unit D belonging to cyan is set as the inspection target, the discharging unit D that corresponds to each of the 2M nozzles N belonging to the nozzle arrays Ln-CY1 and the Ln-CY2 is set as the target of the discharge state determination process. When the discharging unit D belonging to magenta is set as the inspection target, the discharging unit D that corresponds to each of the 2M nozzles N belonging to the nozzle arrays Ln-MG1 and the Ln-MG2 is set as the target of the discharge state determination process. When the discharging unit D belonging to yellow is set as the inspection target, the discharging unit D that corresponds to each of the 2M nozzles N belonging to the nozzle arrays Ln-YL1 and the Ln-YL2 is set as the target of the discharge state determination process.

Accordingly, the discharging unit D belonging to black is set as the inspection target once in two instances, and each of the discharging units D belonging to three colors other than black is set as the inspection target once in six instances. The storage unit 14 retains setting data representing the order of inspection of the discharging units D in advance, and the control unit 11, as the inspection target setting process, changes the discharging unit D to be set as the inspection target on the basis of the setting data each time the discharge state inspection is performed. Then, the control unit 11 performs supply of the switching control signal Sw or the like so that the discharge state determination process can be performed on the discharging unit that is set as the inspection target.

The order of inspection of the discharging unit D belonging to cyan, the discharging unit D belonging to magenta, and the discharging unit D belonging to yellow is arbitrarily illustrated in FIG. 15. The order of color to which the inspection target discharging unit D belongs to may be, for example, "black→magenta→black→cyan→black→yellow→black→magenta→ . . . ". The point is that the inspection instances for the discharging unit D belonging to one of three colors other than black may be set as the inspection instances interposing the inspection instance for the discharging unit D belonging to black and that the inspection instance for the discharging unit D belonging to cyan, the inspection instance for the discharging unit D belonging to magenta, and the inspection instance for the discharging unit D belonging to yellow may be repeated in a predetermined order.

Configuration and Operation of Head Driver

Figure 16:
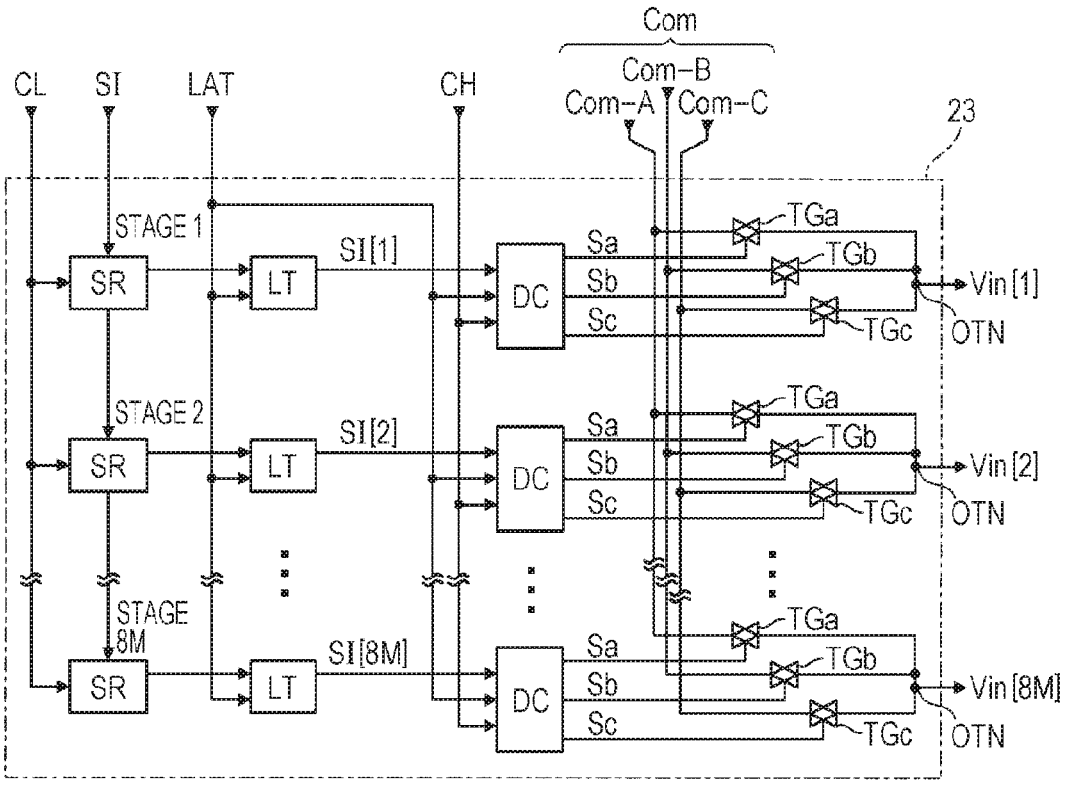
FIG. 16 is a block circuit diagram illustrating a circuit configuration of a drive signal generating unit.

A configuration and operation of the head driver 22 (the drive signal generating unit 23, the abnormal discharge detecting unit 24, and the switching unit 25) will be described with reference to FIG. 16 to FIG. 23. FIG. 16 is a block diagram illustrating a configuration of the drive signal generating unit 23 of the head driver 22.

As illustrated in FIG. 16, the drive signal generating unit 23 includes one set of a shift register SR, a latch circuit LT, and a decoder DC for each of the 8M discharging units D. In addition, the drive signal generating unit 23 includes one set of three transmission gates TGa, TGb, and TGc for each of the 8M discharging units D. Hereinafter, the shift register SR, the latch circuit LT, the decoder DC, and the three transmission gates TGa, TGb, and TGc associated with one discharging unit D may be regarded as one set, and each element circuit constituting one set may be referred to as a first stage element circuit, a second stage element circuit, . . . , an 8M-th stage element circuit in order from the top of FIG. 16.

The drive signal generating unit 23 is supplied with a clock signal CL, the printing signal SI, a latch signal LAT, a change signal CH, and the drive waveform signal Com (Com-A, Com-B, and Com-C) from the control unit 11.

The printing signal SI is a digital signal that defines the amount of ink to be discharged from each discharging unit D. More specifically, the printing signal SI of the present embodiment defines the amount of ink discharged by each discharging unit D in three bits of a high-order bit b1, a medium-order bit b2, and a low-order bit b3. The printing signal SI, for example, is serially transferred to the drive signal generating unit 23 in synchronization with the clock signal CL supplied from the control unit 11. The drive signal generating unit 23 generates the drive signal Vin used in printing on the basis of the printing signal SI to control the amount of ink discharged from each discharging unit D. Accordingly, four levels of no recording, a small dot, a medium dot, and a large dot can be represented at each dot of the recording paper P. Furthermore, the drive signal generating unit 23 generates the drive signal Vin used in inspection to cause residual vibration and to inspect the state of discharge of ink on the basis of the printing signal SI, thereby enabling determination of a discharge state.

The 8M shift registers SR are connected in cascade. Each of the 8M shift registers SR temporarily retains a three-bit digital signal. The printing signal SI is input into the first stage shift register SR, and the clock signal CL is input into each of the 8M shift registers SR. The 8M shift registers SR shift the printing signal SI from the first stage shift register SR to the 8M-th shift register SR with the clock signal CL as a shift clock. When the printing signal SI is transferred to the 8M shift registers SR and the input of the clock signal CL is stopped, the m-th stage (m is a natural number satisfying $1 \leq m \leq 8M$) shift register SR retains the amount of ink to be discharged from the m-th stage discharging unit as three-bit data.

The latch signal LAT is input into the 8M latch circuits LT. When the latch signal LAT rises, the data retained by the m-th shift register SR is latched in the m-th stage latch circuit LT. That is, when the latch signal LAT rises, the three-bit data retained by each of the 8M shift registers SR is latched in the 8M latch circuits LT at the same time, and the printing signal SI is latched in the 8M latch circuits LT. Each of the reference signs SI[1], SI[2], . . . , SI[8M] illustrated in FIG. 16 denotes the three-bit data that is latched by the latch circuits LT connected to the first stage, second stage, . . . , and 8M-th stage shift registers SR.

The control unit 11 controls the timing of various processes performed by the printer 10 by using a system clock and treats each of the period of performing the printing process and the period of performing the discharge state determination process as one operation period.

The control unit 11 treats the period for transferring the printing signal SI to the head unit 20 to generate the drive signal Vin as one unit operation period Tu and includes a plurality of unit operation periods in one operation period. The unit operation period Tu for performing the printing process is the period in which the printing signal SI is used to perform the printing process and is referred to as a printing unit operation period Tup. The unit operation period Tu for performing the discharge state determination process is the period in which the printing signal SI is used to perform the discharge state determination process and is referred to as an inspection unit operation period Tuj.

The control unit 11 treats the period in which at least a part of the printing region Fp of the recording paper P is positioned under the recording head 21 (−Z side) as the printing unit operation period Tup and controls operation of each unit of the printer 10 in such a manner that the printing process is performed during the printing unit operation period Tup. Meanwhile, the control unit 11 treats a period included in the above paper exchange period as the inspection unit operation period Tuj and controls operation of each unit of the printer 10 in such a manner that the discharge state determination process is performed during the inspection unit operation period Tuj.

The control unit 11 may set the inspection unit operation period Tuj to a period that is included in the combination of the paper exchange period and the period in which only the marginal region Fm of the recording paper P is positioned under the recording head 21 (−Z side). The point is that the discharge state determination process may be performed during the period in which only the marginal region Fm of the recording paper P is positioned under the recording head 21 (−Z side). In such a case, the discharge state determination process that is performed between the printing process performed on one recording paper P and the printing process performed on the recording paper P subsequent to the one recording paper P is regarded as one instance of the discharge state inspection.

The control unit 11, for example, treats the period in which strain is exerted on the piezoelectric element 210 and is removed therefrom as one control period. The control unit 11 sets one control period Ts1 and another control period Ts2 subsequent thereto as one unit operation period Tu. The control unit 11 sets the length of the control period Ts1 and the length of the control period Ts2 equally.

The control unit 11 transfers the printing signal SI to the drive signal generating unit 23 and supplies the latch signal LAT for latching the transferred printing signal SI to the drive signal generating unit 23 in each unit operation period Tu. Accordingly, the control unit 11 controls the drive signal generating unit 23 in such a manner that the drive signal Vin is supplied to the 8M discharging units D in each unit operation period Tu.

More specifically, the control unit 11 supplies the printing signal SI used in printing to the drive signal generating unit 23 in the printing unit operation period Tup and controls the drive signal generating unit 23 in such a manner that the drive signal Vin used in printing is supplied to each of the 8M discharging units D. Accordingly, the 8M discharging units D discharge ink in an amount corresponding to the print data PD to the recording paper P, and the print target corresponding to the print data PD is formed on the recording paper P.

The control unit 11 supplies the printing signal SI used in inspection to the drive signal generating unit 23 in the inspection unit operation period Tuj and controls the drive signal generating unit 23 in such a manner that the drive signal Vin used in inspection is supplied to each of the 8M discharging units D. Accordingly, a determination of whether an abnormal discharge occurs in each discharging unit D is performed.

The decoder DC decodes three bits of the printing signal SI latched by the latch circuit LT and outputs selection signals Sa, Sb, and Sc in each of the control periods Ts1 and Ts2.

FIG. 17 is a truth table illustrating the content of decoding performed by the decoder DC.

As illustrated in FIG. 17, when the printing signal SI[m] corresponding to the m-th stage represents, for example, (b1, b2, b3)=(1, 0, 0), the m-th stage decoder DC sets the level of the selection signal Sa to a high level H in the control period Ts1. In addition, the m-th stage decoder DC sets the level of the selection signals Sb and Sc to a low level L. In the control period Ts2, the m-th stage decoder DC sets the level of the selection signal Sb to the high level H and sets the level of the selection signals Sa and Sc to the low level L.

When, for example, the low-order bit b3 is "1", that is, in the case of (b1, b2, b3)=(0, 0, 1), the m-th stage decoder DC sets the level of the selection signal Sc to the high level H and sets the level of the selection signals Sa and Sb to the low level L in the control periods Ts1 and Ts2.

The transmission gate TGa is ON when the selection signal Sa is at the H level and is OFF when the selection signal Sa is at the L level. The transmission gate TGb is ON when the selection signal Sb is at the H level and is OFF when the selection signal Sb is at the L level. The transmission gate TGc is ON when the selection signal Sc is at the H level and is OFF when the selection signal Sc is at the L level.

When, for example, the printing signal SI[m] in the m-th stage represents (b1, b2, b3)=(1, 0, 0), the transmission gate TGa is ON, and the transmission gates TGb and TGc are OFF in the control period Ts1. In the control period Ts2, the transmission gate TGb is ON, and the transmission gates TGa and TGc are OFF.

The drive waveform signal Com-A is supplied to one end of the transmission gate TGa. The drive waveform signal Com-B is supplied to one end of the transmission gate TGb. The drive waveform signal Com-C is supplied to one end of the transmission gate TGc. The other ends of the transmission gates TGa, TGb, and TGc are connected in common to an output terminal OTN that leads to the switching unit 25.

The transmission gates TGa, TGb, and TGc are exclusively ON. One of the drive waveform signals Com-A, Com-B, and Com-C selected in each of the control periods Ts1 and Ts2 is output as the drive signal Vin[m] to the m-th stage output terminal OTN and is supplied to the m-th stage discharging unit D through the switching unit 25.

Figure 18:
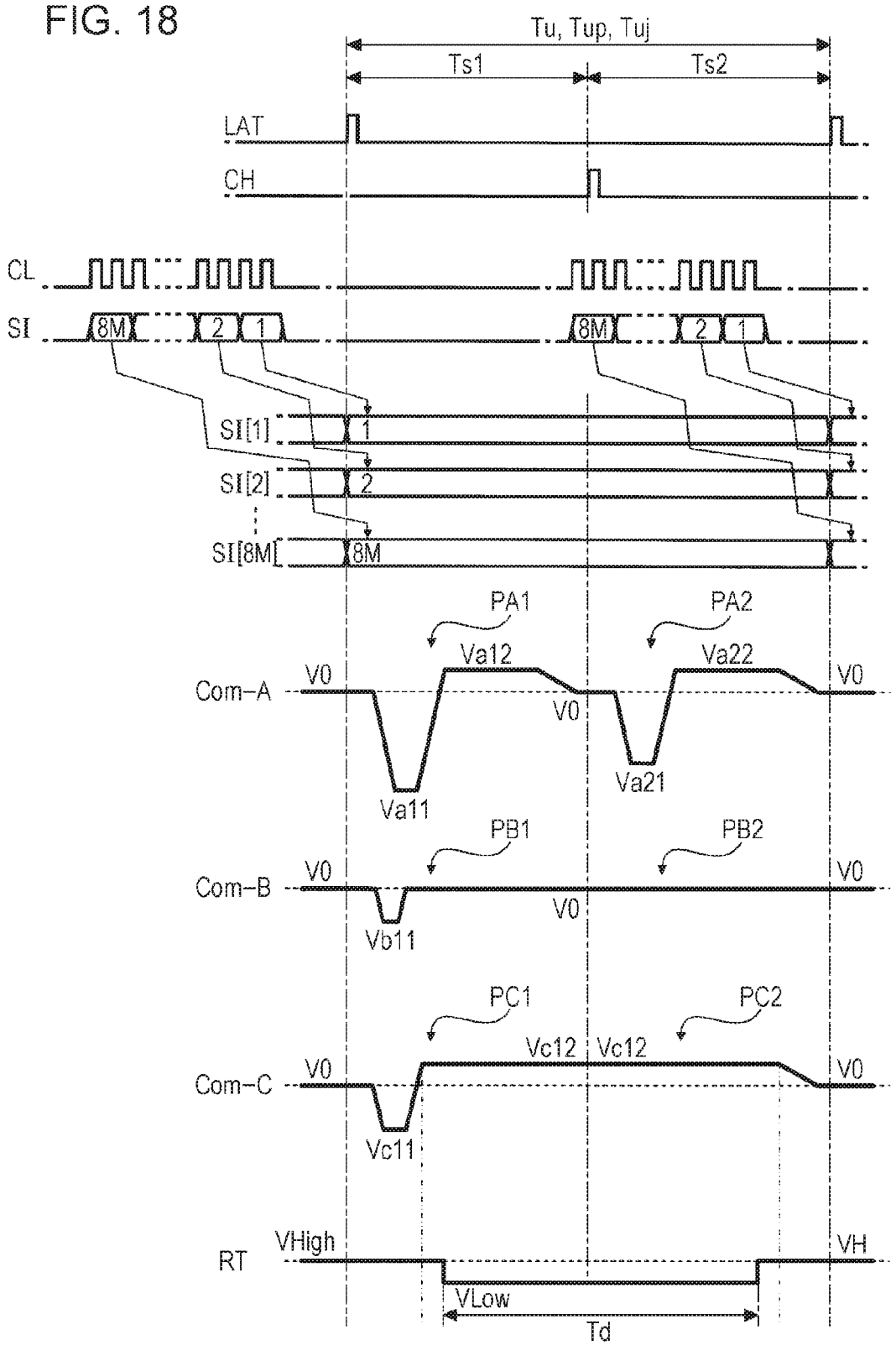
FIG. 18 is a timing chart illustrating operation of the drive signal generating unit.

As illustrated in FIG. 18, the unit operation period Tu is defined by the latch signal LAT output from the control unit 11. The control periods Ts1 and Ts2 included in the unit operation period Tu are defined by the latch signal LAT and the change signal CH output from the control unit 11.

The drive waveform signal Com-A supplied from the control unit 11 in the unit operation period Tu is a signal for generating the drive signal Vin used in printing. The drive waveform signal Com-A is configured of a unit waveform PA1 supplied during the control period Ts1 and a unit waveform PA2 supplied during the control period Ts2.

The starting and end potentials of each of the unit waveform PA1 and the unit waveform PA2 are set to a reference potential V0. The potential difference between a minimum potential Va11 and a maximum potential Va12 of the unit waveform PA1 is greater than the potential difference between a minimum potential Va21 and a maximum potential Va22 of the unit waveform PA2. Thus, when the piezoelectric element 210 included in each discharging unit D is driven by the unit waveform PA1, the amount of ink discharged from the nozzle N included in the discharging unit D is larger than the amount of ink discharged in the case where the piezoelectric element 210 is driven by the unit waveform PA2.

The drive waveform signal Com-B supplied from the control unit 11 in the unit operation period Tu is also a signal for generating the drive signal Vin used in printing. The drive waveform signal Com-B is configured of a unit waveform PB1 supplied during the control period Ts1 and a unit waveform PB2 supplied during the control period Ts2.

The starting and end potentials of the unit waveform PB1 are set to the reference potential V0, and the unit waveform PB2 is maintained at the reference potential V0 during the control period Ts2. The potential difference between a minimum potential Vb11 and the maximum potential (the reference potential V0 in the example illustrated in FIG. 18) of the unit waveform PB1 is smaller than the potential difference between the minimum potential Va21 and the maximum potential Va22 of the unit waveform PA2. Even if the piezoelectric element 210 included in each discharging unit D is driven by the unit waveform PB1, ink is not discharged from the nozzle N included in the discharging unit D. Similarly, even if the unit waveform PB2 is supplied to the piezoelectric element 210, ink is not discharged from the nozzle N.

The drive waveform signal Com-C supplied from the control unit 11 in the unit operation period Tu is a signal for generating the drive signal Vin used in inspection. The drive waveform signal Com-C is configured of a unit waveform PC1 supplied during the control period Ts1 and a unit waveform PC2 supplied during the control period Ts2. The unit waveform PC1 transitions from the reference potential V0 to a minimum potential Vc11 and to a maximum potential Vc12 and then is maintained at the maximum potential Vc12 until the end of the control period Ts1. The unit waveform PC2 is maintained at the maximum potential Vc12 and transitions from the maximum potential Vc12 to the reference potential V0 before the end of the control period Ts2.

In the present embodiment, the potential difference between the minimum potential Vc11 and the maximum potential Vc12 of the unit waveform PC1 is smaller than the potential difference between the minimum potential Va21 and the maximum potential Va22 of the unit waveform PA2, and the potential of the unit waveform PC1 is set in such a manner that ink is not discharged from the discharging unit D when the discharging unit D is driven by the drive signal Vin used in inspection having the unit waveform PC1.

That is, in the present embodiment, the discharge state determination process is so-called non-discharging inspection that determines the state of ink discharged from the discharging unit D on the basis of residual vibration occurring in the discharging unit D when the discharging unit D is driven in such a manner that ink is not discharged.

The 8M latch circuits LT output the printing signals SI[1], SI[2], . . . , SI[8M] at the timing of the rise of the latch signal LAT, that is, at the timing of the start of the unit operation period Tu. The m-th stage decoder DC outputs the selection signals Sa, Sb, and Sc on the basis of the previous decoding content illustrated in FIG. 17 in each of the control periods Ts1 and Ts2 in response to the printing signal SI[m]. The m-th stage transmission gates TGa, TGb, and TGc, as described above, select one of the drive waveform signals Com-A, Com-B, and Com-C on the basis of the selection signals Sa, Sb, and Sc and output the selected drive waveform signal Com as the drive signal Vin[m].

A switching period specifying signal RT illustrated in FIG. 18 is a signal that defines a switching period Td. The switching period specifying signal RT and the switching period Td will be described below.

Next, the waveform of the drive signal Vin output from the drive signal generating unit 23 during the unit operation period Tu will be described with reference to FIG. 19.

Figure 19:
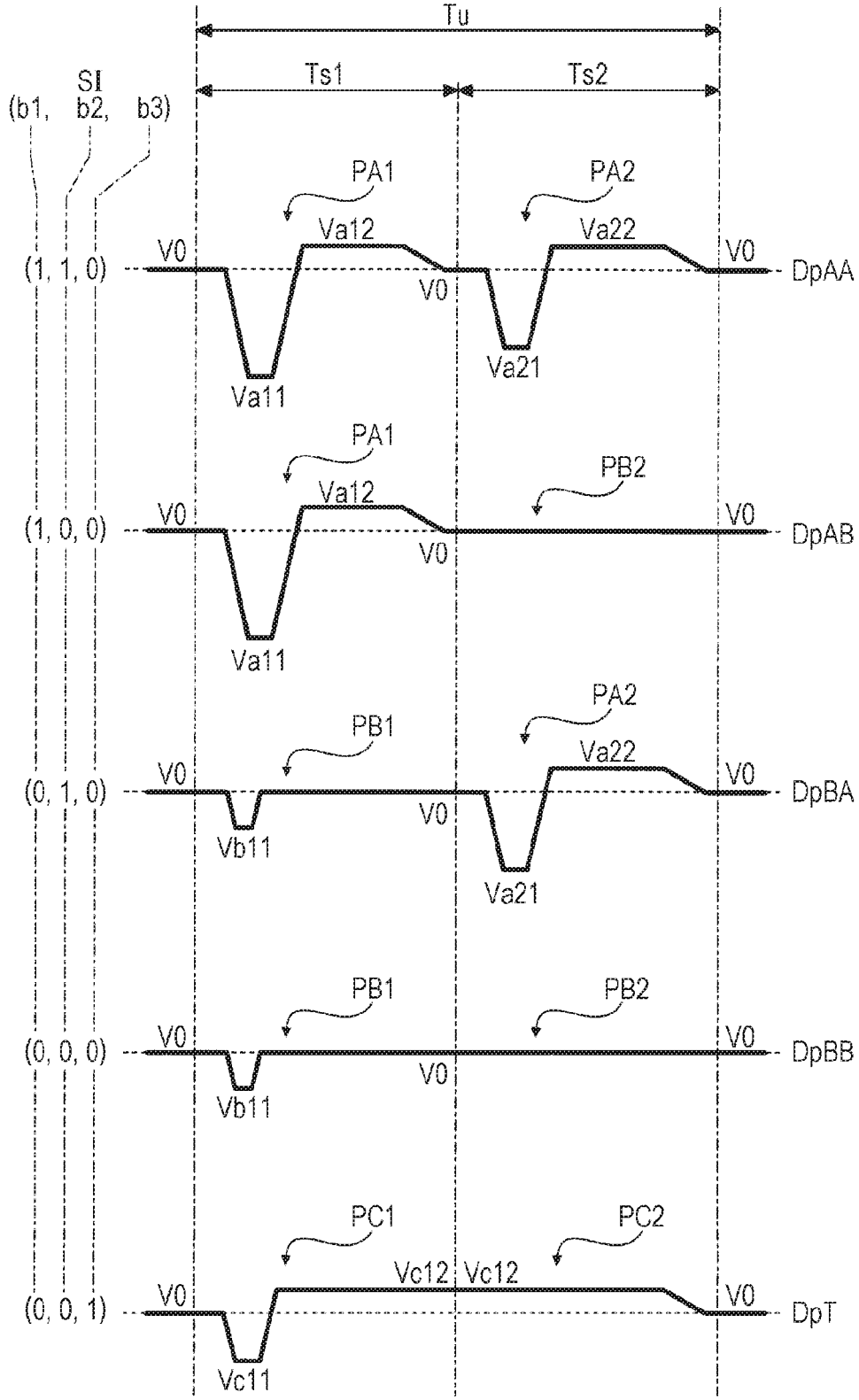
FIG. 19 is a waveform diagram illustrating a temporal trend in the waveform of a drive signal.

As illustrated in FIG. 19, when the printing signal SI[m] supplied in the unit operation period Tu represents (b1, b2, b3)=(1, 1, 0), the levels of the selection signals Sa, Sb, and Sc are respectively set to the H level, the L level, and the L level in the control period Ts1. Thus, the transmission gate TGa selects the drive waveform signal Com-A and outputs the unit waveform PA1 as the drive signal Vin[m]. Similarly, in the control period Ts2, the drive waveform signal Com-A is selected, and the unit waveform PA2 is output as the drive signal Vin[m]. In this case, the drive signal Vin[m] supplied to the m-th stage discharging unit D during the unit operation period Tu is the drive signal Vin used in printing, and the waveform thereof is a waveform DpAA that includes the unit waveform PA1 and the unit waveform PA2. As a consequence, the m-th stage discharging unit D discharges a medium amount of ink on the basis of the unit waveform PA1 and discharges a small amount of ink on the basis of the unit waveform PA2 in the unit operation period Tu, and the ink discharged twice is combined on the recording paper P to form a large dot on the recording paper P.

When the printing signal SI[m] supplied in the unit operation period Tu represents (b1, b2, b3)=(1, 0, 0), the drive waveform signal Com-A is selected in the control period Ts1, and the drive waveform signal Com-B is selected in the control period Ts2. Thus, the drive signal Vin[m] supplied to the m-th stage discharging unit D during the unit operation period Tu is the drive signal Vin used in printing, and the waveform thereof is a waveform DpAB that includes the unit waveform PA1 and the unit waveform PB2. As a consequence, the m-th stage discharging unit D discharges a medium amount of ink on the basis of the unit waveform PA1 in the unit operation period Tu, and a medium dot is formed on the recording paper P.

When the printing signal SI[m] supplied in the unit operation period Tu represents (b1, b2, b3)=(0, 1, 0), the drive waveform signal Com-B is selected in the control period Ts1, and the drive waveform signal Com-A is selected in the control period Ts2. Thus, the drive signal Vin[m] supplied to the m-th stage discharging unit D during the unit operation period Tu is the drive signal Vin used in printing, and the waveform thereof is a waveform DpBA that includes the unit waveform PB1 and the unit waveform PA2. As a consequence, the m-th stage discharging unit D discharges a small amount of ink on the basis of the unit waveform PA2 in the unit operation period Tu, and a small dot is formed on the recording paper P.

When the printing signal SI[m] supplied in the unit operation period Tu represents (b1, b2, b3)=(0, 0, 0), the drive waveform signal Com-B is selected in the control period Ts1 and in the control period Ts2. Thus, the drive signal Vin[m] supplied to the m-th stage discharging unit D during the unit operation period Tu is the drive signal Vin used in printing, and the waveform thereof is a waveform DpBB that includes the unit waveform PB1 and the unit waveform PB2. As a consequence, ink is not discharged from the m-th stage discharging unit D in the unit operation period Tu, and no dot is formed on the recording paper P (no recording).

When the printing signal SI[m] supplied in the unit operation period Tu represents (b1, b2, b3)=(0, 0, 1), the drive waveform signal Com-C is selected in the control period Ts1 and in the control period Ts2. Thus, the drive signal Vin[m] supplied to the m-th stage discharging unit D during the unit operation period Tu is the drive signal Vin used in inspection, and the waveform thereof is a waveform DpT that includes the unit waveform PC1 and the unit waveform PC2.

As such, the printing signal SI used in printing is a signal in which the three-bit data (b1, b2, b3)=(1, 1, 0), (1, 0, 0), (0, 1, 0), or (0, 0, 0) is combined in an amount corresponding to the 8M discharging units D and is generated on the basis of the print data PD. Meanwhile, the printing signal SI used in inspection is a signal in which the three-bit data (b1, b2, b3)=(0, 0, 1) is repeated in an amount corresponding to the 8M discharging units D and is generated on the basis of data, retained in advance by the storage unit 14, for generating the printing signal SI used in inspection.

The control unit 11 supplies the printing signal SI used in printing to the drive signal generating unit 23 in the printing unit operation period Tup and controls the drive signal generating unit 23 in such a manner that the drive signal Vin used in printing is supplied to each of the 8M discharging units D. The control unit 11 supplies the printing signal SI used in inspection to the drive signal generating unit 23 in the inspection unit operation period Tuj and controls the drive signal generating unit 23 in such a manner that the drive signal Vin used in inspection is supplied to each of the 8M discharging units D.

Figure 20:
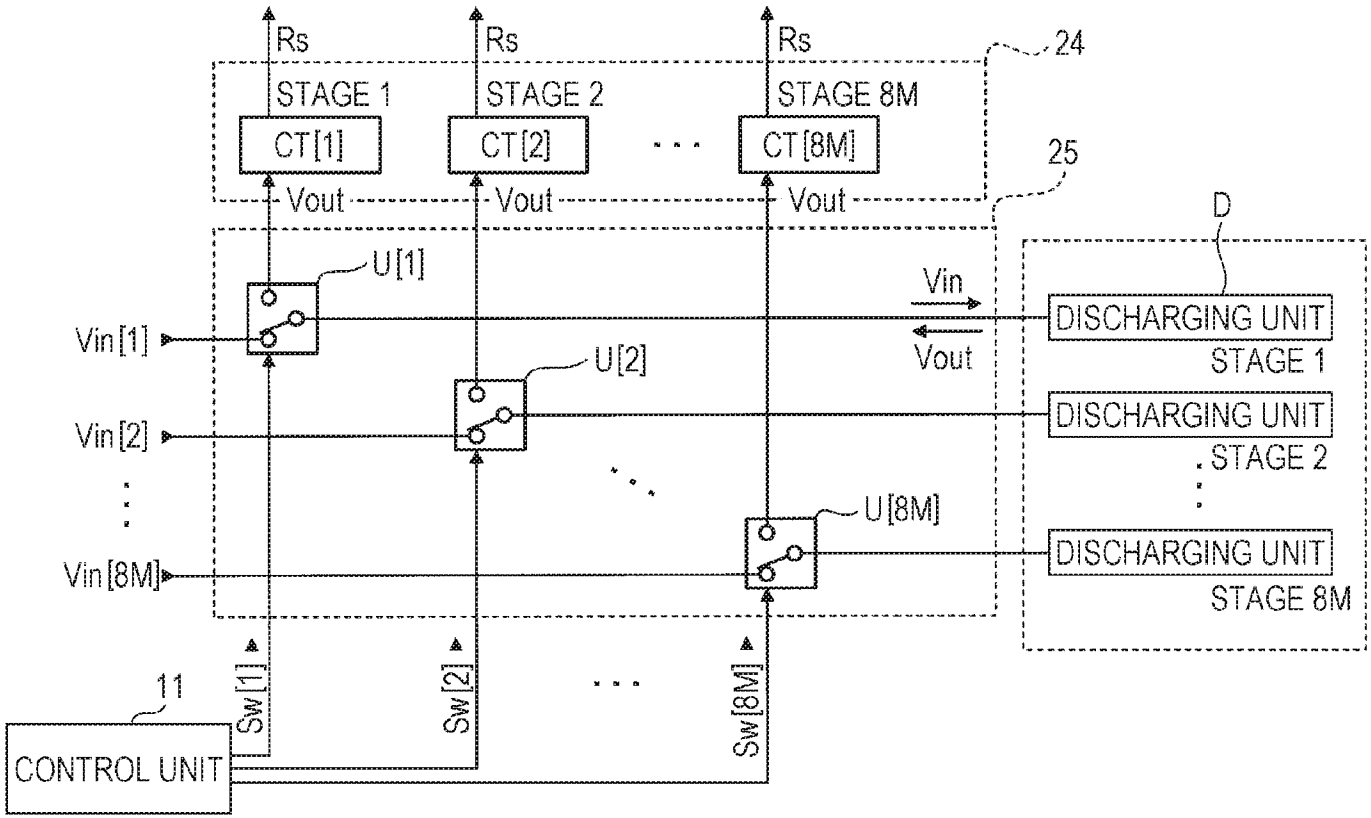
FIG. 20 is a block diagram illustrating a circuit configuration of a switching unit.

FIG. 20 is a block diagram illustrating a configuration of the switching unit 25 of the head driver 22. In addition, FIG. 20 illustrates an electrical connection relationship between the switching unit 25, the abnormal discharge detecting unit 24, the discharging unit D, and the drive signal generating unit 23.

As illustrated in FIG. 20, the switching unit 25 includes 8M first to 8M-th stage switching circuits U (U[1], U[2], . . . , U[8M]) that correspond one-to-one to the 8M discharging units D. The abnormal discharge detecting unit includes 8M first to 8M-th stage abnormal discharge detecting circuits CT (CT[1], CT[2], . . . , CT[8M]) that correspond one-to-one to the 8M discharging units D.

The m-th stage switching circuit U[m] electrically connects the piezoelectric element 210 of the m-th stage discharging unit D to either the m-th stage output terminal OTN included in the drive signal generating unit 23 or the m-th stage abnormal discharge detecting circuit CT[m] included in the abnormal discharge detecting unit 24.

Hereinafter, the state where the discharging unit D and the output terminal OTN of the drive signal generating unit 23 are electrically connected in each switching circuit U will be referred to as a first connection state. In addition, the state where the discharging unit D and the abnormal discharge detecting circuit CT of the abnormal discharge detecting unit 24 are electrically connected will be referred to as a second connection state.

The control unit 11 outputs the switching control signal SW for controlling the connection state of each switching circuit U to each switching circuit U.

Specifically, when the m-th stage discharging unit D is used in the printing process during the unit operation period Tu, that is, during the printing unit operation period Tup, the control unit 11 supplies the switching control signal Sw[m] that causes the switching circuit U[m] corresponding to the m-th stage discharging unit D to maintain the first connection state during the entire printing unit operation period Tup to the switching circuit U[m]. Thus, the drive signal Vin is supplied from the drive signal generating unit 23 to the m-th stage discharging unit D during the entire printing unit operation period Tup.

Meanwhile, when the m-th stage discharging unit D is the target of the discharge state determination process in the unit operation period Tu, that is, when the m-th stage discharging unit D is the target of the discharge state determination process in the inspection unit operation period Tuj, the control unit 11 supplies the switching control signal Sw[m] that causes the switching circuit U[m] corresponding to the m-th stage discharging unit D to be in the first connection state during the period other than the switching period Td included in the inspection unit operation period Tuj and to be in the second connection state during the switching period Td to the switching circuit U[m]. Thus, when the m-th stage discharging unit D is the target of the discharge state determination process in the inspection unit operation period Tuj, the drive signal Vin is supplied from the drive signal generating unit 23 to the m-th stage discharging unit D during the period other than the switching period Td included in the inspection unit operation period Tuj, and during the switching period Td, the residual vibration signal Vout is supplied from the m-th stage discharging unit D to the abnormal discharge detecting circuit CT[m].

The control unit 11 supplies the switching control signal Sw to the switching circuit U in the inspection unit operation period Tuj belonging to the discharge state inspection so that inspection of the discharging unit D in a certain stage that is set as the target of the discharge state inspection by the inspection target setting process can be performed in that instance of the discharge state inspection. That is, the switching control signal Sw is supplied to the switching circuit U in the inspection unit operation period Tuj belonging to the discharge state inspection so that the residual vibration signal Vout can be supplied from the discharging unit D set as the inspection target to the abnormal discharge detecting circuit CT by switching the connection state of the switching circuit U as described above while the discharge state inspection is performed.

The switching period Td is a period in which the potential of the switching period specifying signal RT generated by the control unit 11 is set to a potential VLow as previously illustrated in FIG. 18. Specifically, the switching period Td is a period that is set to be a part of or the entire period during which the potential Vc12 of the drive waveform signal Com-C (that is, the waveform DpT) is maintained in the unit operation period Tu (inspection unit operation period Tuj).

Figure 21:
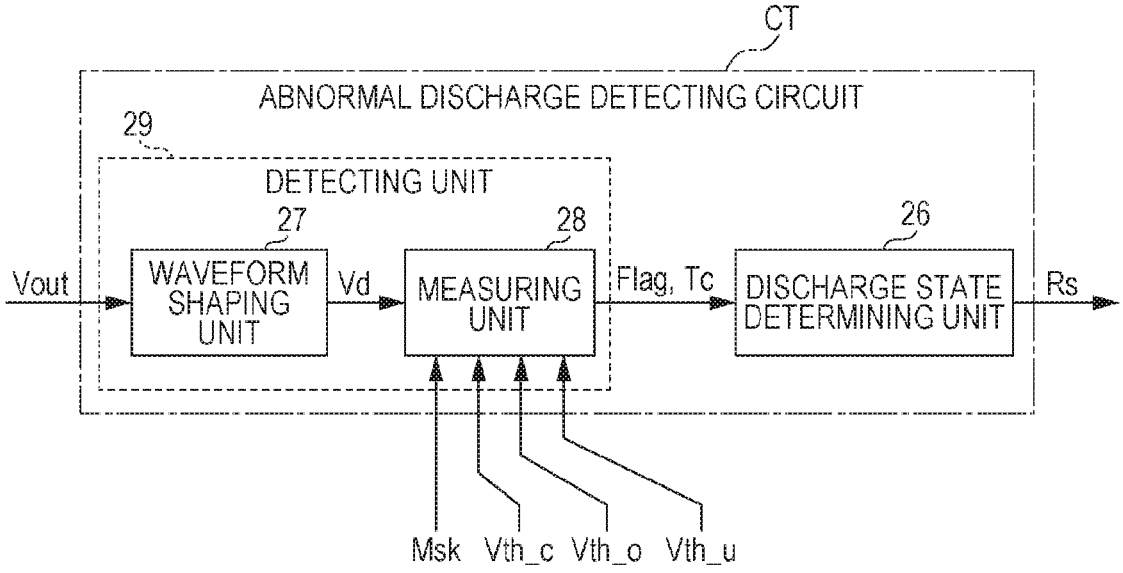
FIG. 21 is a block diagram illustrating a circuit configuration of an abnormal discharge detecting circuit.

The abnormal discharge detecting unit 24 includes 8M abnormal discharge detecting circuits CT (CT[1], CT[2], . . . , CT[8M]) in one-to-one correspondence with the 8M discharging units D. The abnormal discharge detecting circuit CT detects a change in the electromotive force of the piezoelectric element 210 of the discharging unit D as the residual vibration signal Vout during the switching period Td. The abnormal discharge detecting circuit CT will be described with reference to FIG. 21. FIG. 21 is a block diagram illustrating a configuration of the abnormal discharge detecting circuit CT.

As illustrated in FIG. 21, the abnormal discharge detecting circuit CT includes a detecting unit 29 and a discharge state determining unit 26. The detecting unit 29 outputs a detection signal Tc representing the length in time of one cycle of the residual vibration of the discharging unit D on the basis of the residual vibration signal Vout. The discharge state determining unit 26 determines the discharge state of the discharging unit D (that is, determines the presence of an abnormal discharge and determines the cause of an abnormal discharge if exists) on the basis of the detection signal Tc and outputs the determination result signal Rs representing the determination result.

The detecting unit 29 includes a waveform shaping unit 27 and a measuring unit 28. The waveform shaping unit 27 generates a shaped waveform signal Vd by removing a noise component and the like from the residual vibration signal Vout output from the discharging unit D. The measuring unit generates the detection signal Tc on the basis of the shaped waveform signal Vd.

The waveform shaping unit 27, for example, includes a high-pass filter for outputting a signal in which the frequency component lower than the frequency bandwidth of the residual vibration signal Vout is attenuated, a low-pass filter for outputting a signal in which the frequency component higher than the frequency bandwidth of the residual vibration signal Vout is attenuated, and the like and is configured to be capable of outputting the shaped waveform signal Vd by restricting the frequency range of the residual vibration signal Vout and removing a noise component. The waveform shaping unit 27 may be configured to include a negative feedback amplifier for adjusting the amplitude of the residual vibration signal Vout, a voltage follower for converting the impedance of the residual vibration signal Vout to output the shaped waveform signal Vd of a low impedance, and the like.

The measuring unit 28 is supplied with the shaped waveform signal Vd that is shaped from the residual vibration signal Vout in the waveform shaping unit 27. In addition, the measuring unit 28 is supplied with a mask signal Msk generated by the control unit 11, a threshold potential Vth_c set to the potential of the center amplitude level of the shaped waveform signal Vd, a threshold potential Vth_o set to be higher than the threshold potential Vth_c, and a threshold potential Vth_u set to be lower than the threshold potential Vth_c. The measuring unit 28 outputs the detection signal Tc and a validity flag Flag on the basis of the signal and the like. The validity flag Flag indicates whether the value of the detection signal Tc is valid.

Figure 22:
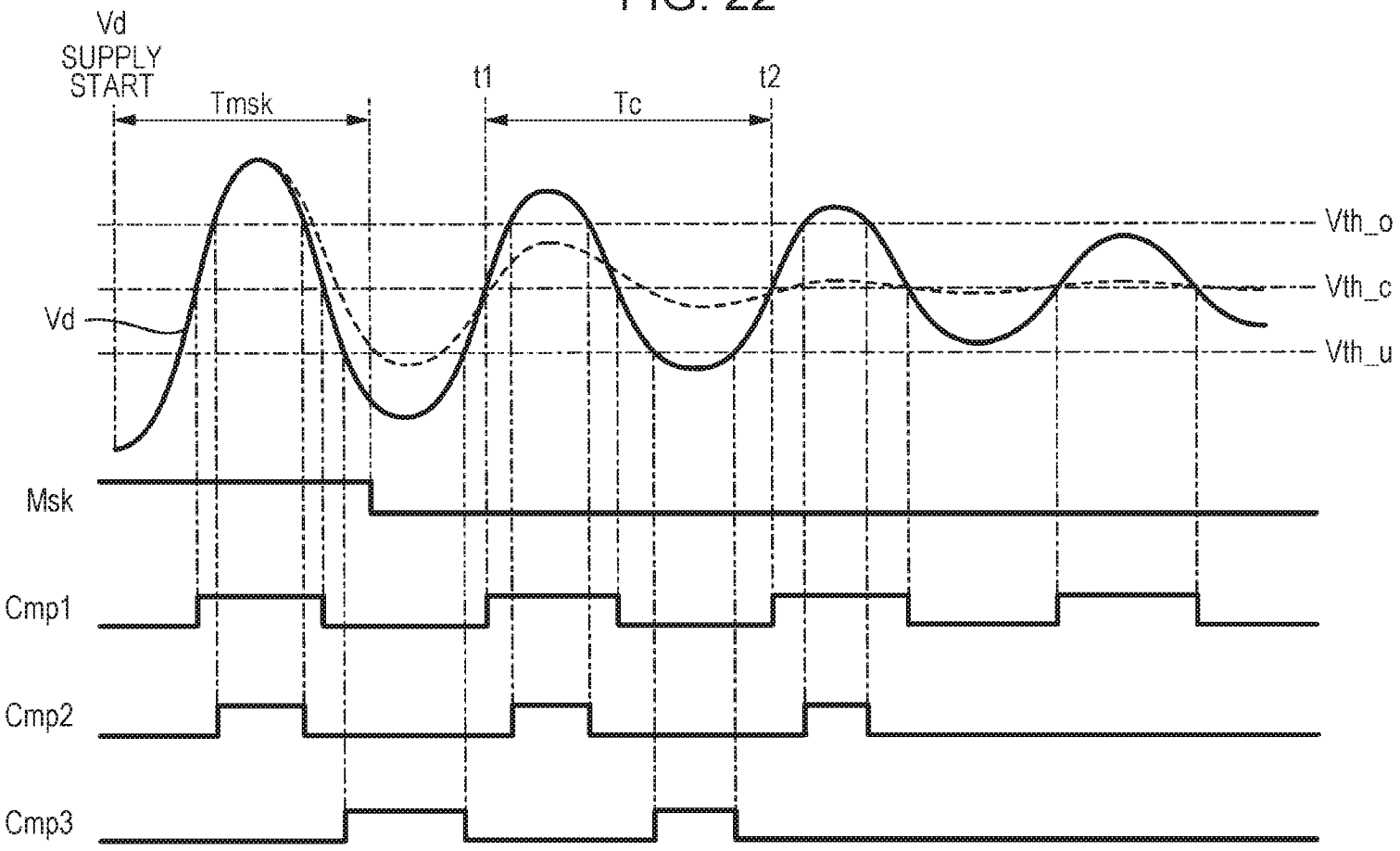
FIG. 22 is a timing chart illustrating operation of the abnormal discharge detecting circuit.

FIG. 22 is a timing chart illustrating operation of the measuring unit 28.

As illustrated in FIG. 22, the measuring unit 28 compares the potential of the shaped waveform signal Vd with the threshold potential Vth_c and generates a comparison signal Cmp1 of which the level is high when the potential of the shaped waveform signal Vd is greater than or equal to the threshold potential Vth_c and is low when the potential of the shaped waveform signal Vd is less than the threshold potential Vth_c.

The measuring unit 28 compares the potential of the shaped waveform signal Vd with the threshold potential Vth_o and generates a comparison signal Cmp2 of which the level is high when the potential of the shaped waveform signal Vd is greater than or equal to the threshold potential Vth_o and is low when the potential of the shaped waveform signal Vd is less than the threshold potential Vth_o.

The measuring unit 28 compares the potential of the shaped waveform signal Vd with the threshold potential Vth_u and generates a comparison signal Cmp3 of which the level is high when the potential of the shaped waveform signal Vd is less than the threshold potential Vth_u and is low when the potential of the shaped waveform signal Vd is greater than or equal to the threshold potential Vth_u.

The mask signal Msk is a signal of which the level is high during a predetermined period Tmsk from the start of supply of the shaped waveform signal Vd from the waveform shaping unit 27. In the present embodiment, the detection signal Tc of high accuracy in which a noise component superimposed immediately after the start of the residual vibration is removed can be obtained by generating the detection signal Tc with the shaped waveform signal Vd as a target only after the period Tmsk elapses.

The measuring unit 28 includes a counter (not illustrated). The counter starts to count a clock signal (not illustrated) after the fall of the mask signal Msk to the low level until a time t1 that is the timing at which the potential of the shaped waveform signal Vd is equal to the threshold potential Vth_c for the first time. That is, the counter starts counting after the fall of the mask signal Msk to the low level until the time t1 that is the earlier of the timing at which the comparison signal Cmp1 rises to the high level for the first time and the timing at which the comparison signal Cmp1 falls to the low level for the first time.

The counter ends the counting of the clock signal at a time t2 that is the timing at which the potential of the shaped waveform signal Vd is equal to the threshold potential Vth_c for the second time after counting is started and outputs the obtained count value as the detection signal Tc. That is, the counter ends counting after the fall of the mask signal Msk to the low level until the time t2 that is the earlier of the timing at which the comparison signal Cmp1 rises to the high level for the second time and the timing at which the comparison signal Cmp1 falls to the low level for the second time. As such, the measuring unit 28 generates the detection signal Tc by measuring the length in time from the time t1 to the time t2 as the length in time of one cycle of the shaped waveform signal Vd.

There is a high possibility that the detection signal Tc is not measured accurately when the amplitude of the shaped waveform signal Vd is small as illustrated by the broken line in FIG. 22. In addition, when the amplitude of the shaped waveform signal Vd is small, there exists a possibility in actuality that an abnormal discharge occurs even if it is determined that the discharge state of the discharging unit D is normal on the basis of only the result of the detection signal Tc. For example, when the amplitude of the shaped waveform signal Vd is small, this is considered as the state where ink is not poured into the cavity 220 and thus is not able to be discharged.

Therefore, the present embodiment determines whether the amplitude of the shaped waveform signal Vd has a sufficient magnitude for measurement of the detection signal Tc and outputs the determination result as the validity flag Flag.

Specifically, the measuring unit 28 sets the value of the validity flag Flag to the value "1" indicating that the detection signal Tc is valid when the potential of the shaped waveform signal Vd exceeds the threshold potential Vth_o and resides below the threshold potential Vth_u in the period during which counting is performed by the counter, that is, in the period from the time t1 to the time t2. In other cases, the measuring unit 28 sets the value of the validity flag Flag to "0". Then, the measuring unit 28 outputs the validity flag Flag. More specifically, the measuring unit 28 sets the value of the validity flag Flag to "1" when the comparison signal Cmp2 rises from the low level to the high level and again falls to the low level and the comparison signal Cmp3 rises from the low level to the high level and again falls to the low level in the period from the time t1 to the time t2. In other cases, the measuring unit 28 sets the value of the validity flag Flag to "0".

As such, in the present embodiment, the measuring unit 28 generates the detection signal Tc indicating the length in time of one cycle of the shaped waveform signal Vd and in addition, determines whether the shaped waveform signal Vd has an amplitude of a sufficient magnitude for measurement of the detection signal Tc. Therefore, an abnormal discharge can be detected more accurately.

The discharge state determining unit 26 determines the state of ink discharged from the discharging unit D on the basis of the detection signal Tc as well as the validity flag Flag and outputs the determination result as the determination result signal Rs. FIG. 23 is a descriptive diagram for describing the content of determination performed by the discharge state determining unit 26.

As illustrated in FIG. 23, the discharge state determining unit 26 compares the length in time indicated by the detection signal Tc with three thresholds (or a part of three thresholds) of a threshold Tth1, a threshold Tth2 representing a longer length in time than the threshold Tth1, and a threshold Tth3 representing a further longer length in time than the threshold Tth2.

The threshold Tth1 is a value that indicates the boundary between the length in time of one cycle of residual vibration in the case where an air bubble occurring in the cavity 220 increases the frequency of residual vibration and the length in time of one cycle of residual vibration in the case of the normal discharge state.

The threshold Tth2 is a value that indicates the boundary between the length in time of one cycle of residual vibration in the case where paper dust attached near the outlet of the nozzle N decreases the frequency of residual vibration and the length in time of one cycle of residual vibration in the case of the normal discharge state.

The threshold Tth3 is a value that indicates the boundary between the length in time of one cycle of residual vibration in the case where solidification or thickening of ink near the nozzle N further decreases the frequency of residual vibration from the case of the attachment of paper dust and the length in time of one cycle of residual vibration in the case where paper dust is attached near the outlet of the nozzle N.

The discharge state determining unit 26 determines that the state of ink discharged from the discharging unit D is normal when the value of the validity flag Flag is "1" and "Tth1≤Tc≤Tth2" is satisfied and sets the determination result signal Rs to the value "1" that indicates the normal discharge state.

Meanwhile, the discharge state determining unit 26 determines that an abnormal discharge occurs because of an air bubble occurring in the cavity 220 when the value of the validity flag Flag is "1" and "Tc<Tth1" is satisfied and sets the determination result signal Rs to the value "2" that indicates occurrence of an abnormal discharge due to an air bubble.

The discharge state determining unit 26 determines that an abnormal discharge occurs because of paper dust attached near the outlet of the nozzle N when the value of the validity flag Flag is "1" and "Tth2<Tc≤Tth3" is satisfied and sets the determination result signal Rs to the value "3" that indicates occurrence of an abnormal discharge due to paper dust.

The discharge state determining unit 26 determines that an abnormal discharge occurs because of thickening of ink near the nozzle N when the value of the validity flag Flag is and "Tth3<Tc" is satisfied and sets the determination result signal Rs to the value "4" that indicates occurrence of an abnormal discharge due to thickening of ink.

The discharge state determining unit 26, when the value of the validity flag Flag is "0", sets the determination result signal Rs to the value "5" that indicates occurrence of an abnormal discharge due to other causes such that ink is not poured.

As described thus far, the discharge state determining unit 26 determines the discharge state of the discharging unit D and outputs the determination result as the determination result signal Rs. Thus, the control unit can find the discharging unit D in which an abnormal discharge occurs on the basis of the determination result signal Rs.

The control unit 11 causes the determination result signal Rs output from the discharge state determining unit 26 to be retained by the storage unit 14 in association with information (for example, the stage number) for identifying the discharging unit D corresponding to the determination result signal Rs.

The control unit 11 either controls operation of the printer 10 in such a manner that the complementation process is performed in the printing process or controls operation of the printer 10 in such a manner that the maintenance process is performed when an abnormal discharge occurs. Accordingly, printing quality degradation due to an abnormal discharge can be suppressed in the printer 10 of the present embodiment.

Complementation Process

The complementation process will be described with reference to FIG. 24 to FIG. 26. As described above, the control unit 11 controls performance of the complementation process that complements one discharging unit D with another discharging unit D when an abnormal discharge occurs in one discharging unit D (when the state of ink discharged is abnormal).

The printer 10 is configured to be capable of performing the complementation process in one of a same array nozzle complementation mode, a different color nozzle complementation mode, and a same color different array nozzle complementation mode. Hereinafter, the nozzle N included in the discharging unit D in which an abnormal discharge occurs will be referred to as an abnormally discharging nozzle N-TG.

Figure 24:
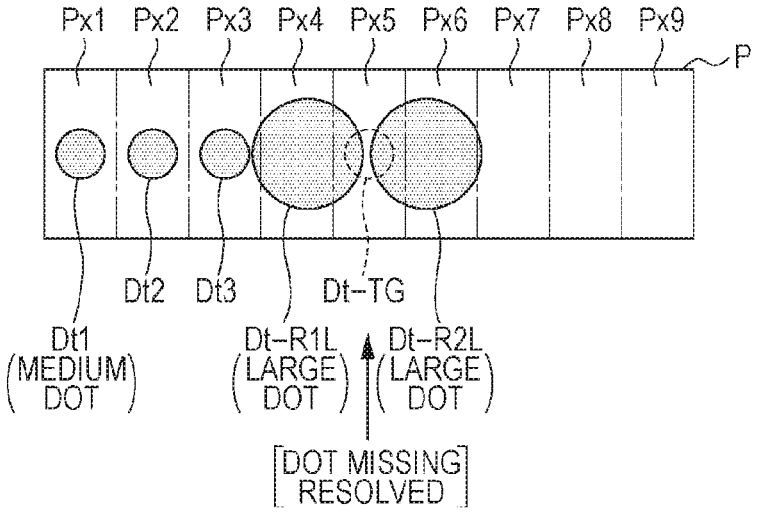
FIG. 24 is a descriptive diagram for describing a complementation process in a same array nozzle complementation mode.
Figure 25:
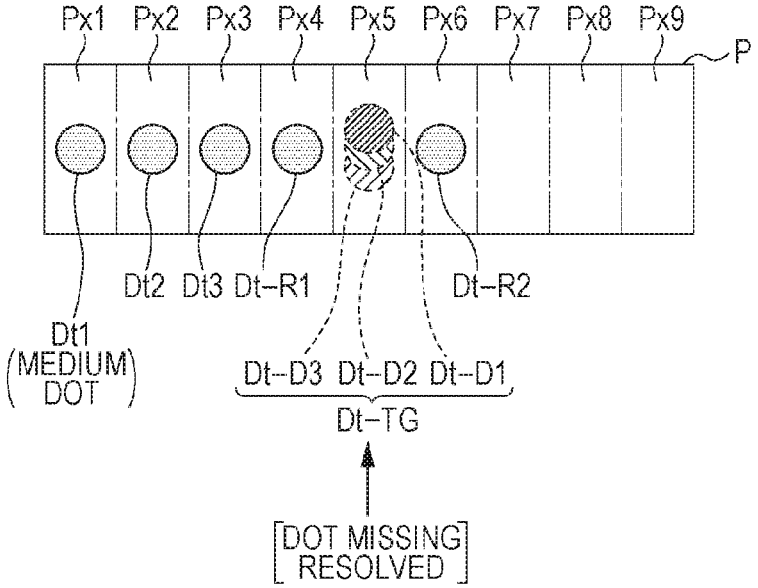
FIG. 25 is a descriptive diagram for describing a complementation process in a different color nozzle complementation mode.
Figure 26:
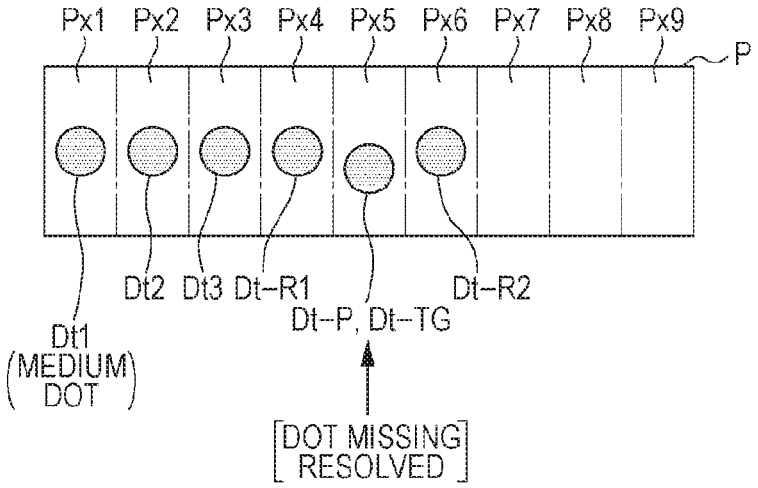
FIG. 26 is a descriptive diagram for describing a complementation process in a same color different array nozzle complementation mode.

In FIG. 24 to FIG. 26, for example, the abnormally discharging nozzle N-TG is assumed to belong to the nozzle array Ln-BK1 that discharges black ink. Also assumed is the case where a dot is omitted at a pixel Px5 where a dot Dt-TG is not formed because an abnormal discharge occurs in the discharging unit including the abnormally discharging nozzle N-TG when medium dots (Dt1, Dt2, Dt3, Dt-R1, Dt-TG, and Dt-R2) are to be formed at each of pixels Px1 to Px6 of pixels Px1 to Px9 on the recording paper P by discharging a medium amount of ink from each nozzle N belonging to the nozzle array Ln-BK1.

When an abnormal discharge occurs and discharging ink from the abnormally discharging nozzle N-TG cannot form a dot on the recording paper P, the complementation process in the same array nozzle complementation mode complements the abnormally discharging nozzle N-TG by increasing the amount of ink discharged from at least one nozzle N, other than the abnormally discharging nozzle N-TG, of the nozzles N belonging to the same nozzle array Ln as the abnormally discharging nozzle N-TG instead of discharging ink from the abnormally discharging nozzle N-TG. Hereinafter, one or more nozzles N that complement the abnormally discharging nozzle N-TG in the same array nozzle complementation mode will be referred to as a same array complementation nozzle N-R.

In the same array nozzle complementation mode, the control unit 11 sets the value of the printing signal SI[m] corresponding to the discharging unit D including the abnormally discharging nozzle N-TG to the value (b1, b2, b3)=(0, 0, 0) that corresponds to "no recording". Then, the control unit 11 controls performance of the complementation process by changing the value of the printing signal SI[m] corresponding to the discharging unit D including the same array complementation nozzle N-R in such a manner that the amount of ink discharged from the same array complementation nozzle N-R is increased from the case where complementation is not performed.

As illustrated in FIG. 24, for example, two nozzles N that are adjacent to the abnormally discharging nozzle N-TG in the Y-axis direction are employed as the same array complementation nozzle N-R. The same array complementation nozzles N-R discharge a medium amount of ink and are supposed to form medium dots if, for example, the complementation process is not performed. However, by performing the complementation process, the amount of ink discharged from the same array complementation nozzles N-R is increased, and large dots Dt-R1L and Dt-R2L are formed. Accordingly, of the two pixels Px4 and Px6 that are adjacent in the Y-axis direction to the pixel Px5 where the medium dot Dt-TG is supposed to be formed by the abnormally discharging nozzle N-TG, the large dot Dt-R1L is formed at the pixel Px4, and the large dot Dt-R2L is formed at the pixel Px6.

According to the complementation process in the same array nozzle complementation mode, even though a dot is not formed by the abnormally discharging nozzle N-TG, dots that are close in the Y-axis direction to the dot which is supposed to be formed by the abnormally discharging nozzle N-TG are largely formed. Thus, visually recognizing no forming of a dot due to the abnormally discharging nozzle N-TG as "dot omission" can be suppressed.

When an abnormal discharge occurs and discharging ink from the abnormally discharging nozzle N-TG cannot form a dot on the recording paper P, the complementation process in the different color nozzle complementation mode complements the abnormally discharging nozzle N-TG by increasing the amount of ink discharged from at least one nozzle N that discharges ink of color different from that of the abnormally discharging nozzle N-TG instead of discharging ink from the abnormally discharging nozzle N-TG. Hereinafter, one or more nozzles N that complement the abnormally discharging nozzle N-TG in the different color nozzle complementation mode will be referred to as a different color complementation nozzle N-D.

In the different color nozzle complementation mode, the control unit 11 sets the value of the printing signal SI[m] corresponding to the discharging unit D including the abnormally discharging nozzle N-TG to the value (b1, b2, b3)=(0, 0, 0) that corresponds to "no recording". Then, the control unit 11 controls performance of the complementation process by changing the value of the printing signal SI[m] corresponding to the discharging unit D including the different color complementation nozzle N-D in such a manner that the amount of ink discharged from the different color complementation nozzle N-D is increased from the case where complementation is not performed.

As illustrated in FIG. 25, for example, three nozzles N that are positioned at approximately the same position as the abnormally discharging nozzle N-TG in the Y-axis direction and that correspond to three colors other than the color of the ink discharged by the abnormally discharging nozzle N-TG are employed as the different color complementation nozzle N-D. The different color complementation nozzles N-D do not discharge ink if, for example, the complementation process is not performed. However, by performing the complementation process, a medium amount of ink is discharged from each of the different color complementation nozzles N-D, and medium dots Dt-D1, Dt-D2, and Dt-D3 of three colors are formed. The medium dots Dt-D1, Dt-D2, and Dt-D3 of three colors formed by the different color complementation nozzles N-D overlap with each other and are arranged at the pixel Px5 where the dot Dt-TG is supposed to be formed by the abnormally discharging nozzle N-TG.

According to the complementation process in the different color nozzle complementation mode, even though a dot is not formed by the abnormally discharging nozzle N-TG, dots of different colors are formed near the position where a dot is supposed to be formed by the abnormally discharging nozzle N-TG. Thus, visually recognizing no forming of a dot due to the abnormally discharging nozzle N-TG as "dot omission" can be suppressed.

There is a high possibility that the dots that are formed by the different color complementation nozzles N-D, when overlapping with each other, are visually recognized as a black dot formed particularly in the configuration in which the abnormally discharging nozzle N-TG is the nozzle N discharging black ink and the different color complementation nozzles N-D are the nozzles N respectively discharging ink of three colors other than black. Therefore, quality degradation of the print target to be formed on the recording paper P is correctly suppressed.

When an abnormal discharge occurs and discharging ink from the abnormally discharging nozzle N-TG cannot form a dot on the recording paper P, the complementation process in the same color different array nozzle complementation mode complements the abnormally discharging nozzle N-TG by increasing the amount of ink discharged from at least one nozzle N that belongs to the different nozzle array Ln from the abnormally discharging nozzle N-TG and that discharges ink of the same color as the abnormally discharging nozzle N-TG instead of discharging ink from the abnormally discharging nozzle N-TG. Hereinafter, one or more nozzles N that complement the abnormally discharging nozzle N-TG in the same color different array nozzle complementation mode will be referred to as a same color different array complementation nozzle N-P.

In the same color different array nozzle complementation mode, the control unit 11 sets the value of the printing signal SI[m] corresponding to the discharging unit D including the abnormally discharging nozzle N-TG to the value (b1, b2, b3)=(0, 0, 0) that corresponds to "no recording". Then, the control unit 11 controls performance of the complementation process by changing the value of the printing signal SI[m] corresponding to the discharging unit D including the same color different array complementation nozzle N-P in such a manner that the amount of ink discharged from the same color different array complementation nozzle N-P is increased from the case where complementation is not performed.

As illustrated in FIG. 26, for example, the abnormally discharging nozzle N-TG is the overlapping nozzle, and one nozzle N that is positioned at approximately the same position as the abnormally discharging nozzle N-TG in the Y-axis direction is employed as the same color different array complementation nozzle N-P. The same color different array complementation nozzle N-P does not discharge ink if, for example, the complementation process is not performed. However, by performing the complementation process, a medium amount of ink is discharged from the same color different array complementation nozzle N-P, and a medium dot Dt-P is formed at the pixel Px5 where the dot Dt-TG is supposed to be formed by the abnormally discharging nozzle N-TG.

According to the complementation process in the same color different array nozzle complementation mode, even though a dot is not formed by the abnormally discharging nozzle N-TG, a dot of the same color is formed near the position where a dot is supposed to be formed by the abnormally discharging nozzle N-TG. Thus, visually recognizing no forming of a dot due to the abnormally discharging nozzle N-TG as "dot omission" can be suppressed.

Performing the complementation in each mode described above can suppress the quality degradation of the print target formed on the recording paper P in the printing process to a small extent in comparison with the case where the complementation process is not performed.

In each complementation mode, the printing unit operation period Tup in which ink is supposed to be discharged from the abnormally discharging nozzle N-TG and the printing unit operation period Tup in which the nozzle N complementing the abnormally discharging nozzle N-TG discharges ink may be the same printing unit operation period Tup or may be different printing unit operation periods Tup. Regarding the positional difference in the X-axis direction between the abnormally discharging nozzle N-TG and the nozzle N complementing the abnormally discharging nozzle N-TG, the transport speed My or the printing unit operation period Tup in which ink is discharged may be appropriately adjusted in such a manner that a dot is formed by the nozzle N complementing the abnormally discharging nozzle N-TG at the pixel where a dot is supposed to be formed by the abnormally discharging nozzle N-TG.

A complementation mode to be selected from the three types of complementation mode to perform the complementation process is determined according to the position of the nozzle N included in the discharging unit D in which an abnormal discharge occurs, the presence of the nozzle N that can complement another, and the like.

In the same array nozzle complementation mode and the same color different array nozzle complementation mode, the color of a dot that is formed when an abnormal discharge does not occur in the discharging unit D including the abnormally discharging nozzle N-TG is the same as the color of a dot that is formed when the complementation process is performed. Therefore, a color difference between the print target represented by the print data PD and the print target actually formed in the printing process can be reduced to a smaller extent.

Meanwhile, in the different color nozzle complementation mode and the same color different array nozzle complementation mode, when the nozzle N that is positioned at approximately the same position as the abnormally discharging nozzle N-TG in the Y-axis direction is employed as the nozzle N complementing the abnormally discharging nozzle N-TG, a positional error in dot formation and a size error of a dot occurring when the complementation process is performed can be reduced in comparison with the case where an abnormal discharge does not occur in the discharging unit D including the abnormally discharging nozzle N-TG. Therefore, a positional or shape difference between the print target represented by the print data PD and the print target actually formed in the printing process can be reduced to a smaller extent.

Therefore, a complementation mode may be selected according to which one of the color accuracy and the positional or shape accuracy is prioritized for the print target to be formed.

In the case of printing a general paper such as a document as in the present embodiment, when an abnormal discharge occurs in the discharging unit D, it is preferable that the control unit 11 selects a complementation mode in the order of priority of "same color different array nozzle complementation mode"→"different color nozzle complementation mode"→"same array nozzle complementation mode" and controls performance of the complementation process on the abnormally discharging nozzle N-TG in the selected complementation mode.

Specifically, the control unit 11 selects the same color different array nozzle complementation mode as a complementation mode when the abnormally discharging nozzle N-TG is the overlapping nozzle and the same color different array complementation nozzle N-P can complement the abnormally discharging nozzle N-TG, that is, when the discharge state of the discharging unit D including the same color different array complementation nozzle N-P is normal.

Meanwhile, if the above condition is not applicable and the complementation process cannot be performed in the same color different array nozzle complementation mode, the control unit 11 selects the different color nozzle complementation mode as a complementation mode when the abnormally discharging nozzle N-TG is the nozzle N discharging black ink and is able to be complemented by the different color complementation nozzles N-D of three colors other than black, that is, when the discharge state of the discharging units D including the different color complementation nozzles N-D is normal.

Furthermore, if the above condition is not applicable and the complementation process cannot be performed in any of the same color different array nozzle complementation mode and the different color nozzle complementation mode, the control unit 11 selects the same array nozzle complementation mode as a complementation mode when the abnormally discharging nozzle N-TG can be complemented by the same array complementation nozzle N-R, that is, when the discharge state of the discharging unit D including the same array complementation nozzle N-R is normal.

When the complementation process cannot be performed in any mode, the control unit 11 controls operation of each unit of the printer 10 in such a manner that the maintenance process is performed on the abnormally discharging nozzle N-TG.

The process of determining a complementation mode is performed on each discharging unit D in which an abnormal discharge is determined to occur. Such a complementation mode determination process is preferably performed in the inspection unit operation period Tuj before the printing process starts.

A complementation mode is preferably selected according to the printing mode when the printer 10 performs the printing process in the set printing mode.

For example, when the set printing mode is the normal printing mode, the control unit 11 preferably selects a complementation mode in the order of priority of "same color different array nozzle complementation mode"→"different color nozzle complementation mode"→"same array nozzle complementation mode" as described above. The different color nozzle complementation mode is selected when the abnormally discharging nozzle N-TG is the nozzle N discharging black ink, in which case the abnormally discharging nozzle N-TG is complemented by the different color complementation nozzles N-D of three colors other than black.

The photograph printing mode is a printing mode for forming a photograph. In the photograph printing mode, the print target is preferably formed in the same color as the print target represented by the print data PD. Therefore, when the set printing mode is the photograph printing mode, the control unit 11 preferably selects a complementation mode in the order of priority of "same color different array nozzle complementation mode"→"same array nozzle complementation mode"→"different color nozzle complementation mode". The different color nozzle complementation mode is selected when the abnormally discharging nozzle N-TG is the nozzle N discharging black ink, in which case the abnormally discharging nozzle N-TG is complemented by the different color complementation nozzles N-D of three colors other than black.

A color difference between the print target represented by the print data PD and the print target actually formed in the printing process can be reduced to a smaller extent by selecting a complementation mode in such an order of priority. Accordingly, even if the complementation process is performed when the printing process is performed in the photograph printing mode, quality degradation of a photograph can be suppressed to a smaller extent.

The figure printing mode is a printing mode for forming a figure such as a design or a graph that represents the shape or position of an object. In the figure printing mode, the print target is preferably formed without a positional or shape difference with the print target represented by the print data PD. Therefore, when the set printing mode is the figure printing mode, the control unit 11 preferably selects a complementation mode in the order of priority of "different color nozzle complementation mode"→"same color different array nozzle complementation mode"→"same array nozzle complementation mode". The different color nozzle complementation mode is selected when the abnormally discharging nozzle N-TG is the nozzle N discharging black ink, in which case the abnormally discharging nozzle N-TG is complemented by the different color complementation nozzles N-D of three colors other than black. In the different color nozzle complementation mode and the same color different array nozzle complementation mode, the nozzle N that is positioned at approximately the same position as the abnormally discharging nozzle N-TG in the Y-axis direction is employed as the nozzle N complementing the abnormally discharging nozzle N-TG. In the same array nozzle complementation mode, two nozzles N that are adjacent to the abnormally discharging nozzle N-TG in the Y-axis direction are employed as the same array complementation nozzle N-R.

A positional or shape difference between the print target represented by the print data PD and the print target actually formed in the printing process can be reduced to a smaller extent by selecting a complementation mode in such an order of priority. Accordingly, even if the complementation process is performed when the printing process is performed in the figure printing mode, a decrease in the accuracy of the position or shape represented by a figure formed can be suppressed to a smaller extent.

The barcode printing mode is a printing mode for printing a barcode or a two-dimensional code from which a reader reads information such as a number or a character. In the barcode printing mode, the print target is preferably formed without a positional or shape difference with the print target represented by the print data PD. Therefore, when the set printing mode is the barcode printing mode, the control unit 11 preferably selects a complementation mode in the order of priority of "same color different array nozzle complementation mode"→"different color nozzle complementation mode". In these modes, the nozzle N that is positioned at approximately the same position as the abnormally discharging nozzle N-TG in the Y-axis direction is employed as the nozzle N complementing the abnormally discharging nozzle N-TG.

A barcode or a two-dimensional code requires further high accuracy in position or shape represented by the formed print target in comparison with a figure formed in the figure printing mode. When the complementation process is performed in the same array nozzle complementation mode, a dot formed is larger than the case where an abnormal discharge does not occur, thereby broadening a line segment. Thus, the information such as a number of a character represented by a barcode or a two-dimensional code may be changed to information that is different from the information to be originally represented. Therefore, when the printing process is performed in the barcode printing mode, the complementation process is preferably not performed in the same array nozzle complementation mode.

The ink that can be used in printing a data pattern region that represents the information such as a number or a character in a barcode or a two-dimensional code is limited to the ink that can absorb light of a predetermined wavelength (red light) emitted by a reader, that is, black or cyan ink. Therefore, the complementation process may be performed on the abnormally discharging nozzle N-TG that discharges black or cyan ink. In addition, since a barcode or a two-dimensional code is not intended to be visually recognized by a user but is favorable if being formed to enable a reader to read the information such as a number or a character, the abnormally discharging nozzle N-TG is not limited to the nozzle N corresponding to black in the different color nozzle complementation mode, and the different color complementation nozzle N-D is not limited to the nozzle N that corresponds to one of three colors other than black. That is, if the abnormally discharging nozzle N-TG is the nozzle N corresponding to black, the nozzle N complementing the abnormally discharging nozzle N-TG may include the nozzle N corresponding to cyan, and if the abnormally discharging nozzle N-TG is the nozzle N corresponding to cyan, the nozzle N complementing the abnormally discharging nozzle N-TG may include the nozzle N corresponding to black.

A positional or shape difference between the print target represented by the print data PD and the print target actually formed in the printing process can be reduced to a smaller extent by selecting a complementation mode in such an order of priority. Accordingly, even if the complementation process is performed when the printing process is performed in the barcode printing mode, a change in the information represented by a barcode or a two-dimensional code formed is suppressed.

Operational Effect

The effect of the present embodiment will be described. In the present embodiment, the frequency of detection of the residual vibration signal Vout from the discharging unit D belonging to black is higher than the frequency of detection of the residual vibration signal Vout from the discharging unit D belonging to each of cyan, magenta, and yellow. In other words, the frequency of determination of the discharge state of the discharging unit D belonging to black is higher than the frequency of determination of the discharging unit D belonging to cyan, the frequency of determination of the discharging unit D belonging to magenta, and the frequency of determination of the discharging unit D belonging to yellow.

Therefore, when an abnormal discharge occurs in the discharging unit D belonging to black, the occurrence of an abnormal discharge is detected early in comparison with the case where the frequency of determination of the discharging unit D belonging to each color is equal.

The frequency of discharge of ink from the discharging unit D belonging to black is higher than the frequency of discharge of ink from the discharging unit D belonging to each of cyan, magenta, and yellow when the print target having a high ratio of use of black is formed as in a general paper such as a document. When the frequency of discharge of specific ink is high, this indicates that a large number of dots are formed by ink discharged from the discharging unit D belonging to the color of the specific ink. Accordingly, an abnormal discharge occurs in the discharging unit D where the frequency of discharge of ink is high, and if the complementation process is not performed, many dots that are to be formed are not formed, and the image quality of the print target formed is significantly degraded. In addition, as the state where an abnormal discharge occurs in the discharging unit D belonging to the color of the specific ink and the complementation process is not performed continues, formation of the print target continues in the state where image quality is significantly degraded, and this causes an increase in the number of damaged papers that are determined as a printing failure.

Regarding such a problem, the frequency of determination of the discharging unit D where the frequency of discharge of ink is high is higher than the frequency of determination of the discharging unit D where the frequency of discharge of ink is low in the present embodiment. Thus, an abnormal discharge of the discharging unit D where the frequency of discharge of ink is high is detected early in comparison with the case where the discharge state of all discharging units D is determined at an equal frequency, and the complementation process can be performed early on the abnormal discharge of the discharging unit D. As a consequence, the period during which the print target is formed in the state where image quality is significantly degraded is shortened, and an increase in the number of damaged papers is suppressed.

As such, according to the present embodiment, the discharge state of the plurality of discharging units D is determined in such a manner that continuous formation of the print target in the state where image quality is degraded is suppressed.

In addition, regarding the color of ink to which the inspection target discharging unit D belongs, black and one of three colors other than black linearly alternate with each other in the order of inspection, and each of cyan, magenta, and yellow is repeated in a predetermined order while interposing black therebetween. In other words, determination of the discharging unit D belonging to black is performed after the printing process that is performed after the discharge state of the discharging unit D belonging to cyan is determined, after the printing process that is performed after the discharge state of the discharging unit D belonging to magenta is determined, and after the printing process that is performed after the discharge state of the discharging unit D belonging to yellow is determined.

By performing determination of a discharge state in such an order, the frequency of determination of the discharging unit D belonging to black can be set to be higher than the frequency of determination of the discharging unit D belonging to cyan, the frequency of determination of the discharging unit D belonging to magenta, and the frequency of determination of the discharging unit D belonging to yellow with a simple configuration without a need to set a complicated inspection order. In addition, since the discharging unit D discharging black ink becomes the inspection target once in two instances, the period during which the print target is formed in the state where image quality is significantly degraded is correctly shortened.

The nozzle N included in the discharging unit D belonging to black in the above embodiment is an example of a first nozzle. In addition, one of the nozzle N included in the discharging unit D belonging to cyan, the nozzle N included in the discharging unit D belonging to magenta, and the nozzle N included in the discharging unit D belonging to yellow is an example of a second nozzle, and one of the other is an example of a third nozzle.

As described thus far, according to the present embodiment, the following effects exemplified can be obtained.

(1) The frequency of determination of the discharging unit D where the frequency of discharge of ink is high is higher than the frequency of determination of the discharging unit D where the frequency of discharge of ink is low. Thus, an abnormal discharge of the discharging unit D where the frequency of discharge of ink is high is detected early in comparison with the case where the discharge state of all discharging units D is determined at an equal frequency, and the complementation process can be performed early on the abnormal discharge of the discharging unit D. That is, the state of liquid discharged from each of the plurality of nozzles N can be determined in such a manner that continuous formation of the print target in the state where image quality is degraded is suppressed.

(2) The frequency of determination of the discharging unit D belonging to black is higher than the frequency of determination of the discharging unit D belonging to cyan, the frequency of determination of the discharging unit D belonging to magenta, and the frequency of determination of the discharging unit D belonging to yellow. Generally, the frequency of use of black ink is highest in the printer 10. Thus, according to such a configuration, an abnormal discharge of the discharging unit D that discharges frequently used ink is detected early, and the complementation process can be performed early on the abnormal discharge of the discharging unit D. Therefore, continuous formation of the print target in the state where image quality is degraded is suppressed.

(3) Detection of the residual vibration signal Vout from the discharging unit D belonging to black is performed after detection of the residual vibration signal Vout from the discharging unit D belonging to cyan, after detection of the residual vibration signal Vout from the discharging unit D belonging to magenta, and after detection of the residual vibration signal Vout from the discharging unit D belonging to yellow. Accordingly, the frequency of determination of the discharging unit D belonging to black can be set to be higher than the frequency of determination of the discharging unit D belonging to cyan, the frequency of determination of the discharging unit D belonging to magenta, and the frequency of determination of the discharging unit D belonging to yellow with a simple configuration.

Modification Example

The above embodiment can be modified as follows.

When the printer 10 performs the printing process in the set printing mode, the pattern of the order of inspection of the discharging units D may be selected according to the printing mode.

In the above embodiment, for example, the frequency of use of black in formation of the print target is considered to be high in each of the normal printing mode, the figure printing mode, and the barcode printing mode. Meanwhile, in the photograph printing mode, the frequency of use of each of cyan, magenta, and yellow in formation of the print target is high in comparison with the case of printing a general paper. Therefore, when one of the normal printing mode, the figure printing mode, and the barcode printing mode is set as a printing mode, the inspection order pattern in which the frequency of determination of the discharging unit D belonging to black is high is selected as an inspection order pattern as in the above embodiment. Meanwhile, when the photograph printing mode is set as a printing mode, the inspection order pattern in which the frequency of determination of the discharging unit D belonging to each color is equal is preferably selected as in the related art.

When, for example, selection of monochrome printing or color printing is available in the host computer 50 and monochrome printing is selected, the inspection order pattern in which the frequency of determination of the discharging unit D belonging to black is high may be selected as an inspection order pattern. When color printing is selected, the inspection order pattern in which the frequency of determination of the discharging unit D belonging to each color is equal may be selected.

As such, the control unit 11 of the printer 10 may select one inspection order pattern as an inspection order pattern for the discharging units D from a plurality of inspection order patterns in which the frequency of determination of the discharging unit D belonging to each color is different per pattern.

In the above embodiment, the order of inspection of the color to which the inspection target discharging unit D belongs is set in such a manner that black and one of three colors other than black linearly alternate with each other and that each of cyan, magenta, and yellow is repeated in a predetermined order while interposing black therebetween. However, the order of inspection of the discharging units D is not limited to this and may be set in such a manner that the frequency of determination of the discharging unit D belonging to black is higher than the frequency of determination of the discharging unit D belonging to cyan, the frequency of determination of the discharging unit D belonging to magenta, and the frequency of determination of the discharging unit D belonging to yellow.

Determination of the discharging unit D belonging to black may be continuous as "black→black→cyan→black→black→magenta→black→black→yellow→ . . . " when, for example, the frequency of discharge of black ink is extremely high. As the frequency of determination of the discharging unit D belonging to black is higher than the frequency of determination of the discharging unit D belonging to cyan, the frequency of determination of the discharging unit D belonging to magenta, and the frequency of determination of the discharging unit D belonging to yellow, an abnormal discharge of the discharging unit D belonging to black can be detected early.

When monochrome printing is selected in the host computer 50, only the discharge state of the discharging unit D belonging to black may be determined. That is, the frequency of determination of the discharge state of the discharging unit D belonging to each of cyan, magenta, and yellow may be zero.

The discharging unit D that is frequently determined is not limited to the discharging unit D belonging to black and may be the discharging unit D belonging to any color other than black.

For example, a user of the printing system 100 adjusts the tone of the print target in the host computer 50, and the adjusted tone information is transmitted from the host computer 50 to the printer 10. Then, the control unit sets the discharging unit D that is the target of determination of a discharge state according to the tone information. For example, when the tone is adjusted in the host computer 50 in such a manner that magenta is intensified, the control unit 11 sets the target of determination of a discharge state in such a manner that the frequency of determination of the discharging unit D belonging to magenta is high. The storage unit 14 may in advance retain data that defines the inspection order in the case of prioritizing the discharging unit D belonging to magenta in inspection, and the control unit 11 may set the target of determination of a discharge state on the basis of the data.

The host computer 50, for example, has the function of extracting high-density color from the target data Ds or the print data PD, that is, the function of calculating color of which the proportion used in printing is high. In addition, the host computer 50 has the function of transmitting the computed color information to the printer 10. The control unit 11 sets the target of determination of a discharge state in such a manner that the frequency of determination of the discharging unit D belonging to the calculated color is high.

The printer 10, for example, has the function of extracting high-density color from the print data PD, that is, the function of calculating color of which the proportion used in printing is high. The printer 10 sets the target of determination of a discharge state in such a manner that the frequency of determination of the discharging unit D belonging to the calculated color is high.

In any of the above cases, the storage unit 14 may in advance retain data that defines the inspection order in the case of prioritizing the discharging unit D belonging to specific color in inspection, and the control unit 11 may set the target of determination of a discharge state on the basis of the data.

As such, the control unit 11 may change the frequently determined discharging unit D according to the print target. According to such a configuration, the discharge state of the discharging unit D is determined with priority that is set in accordance with the print target. Thus, the discharge state of the plurality of discharging units D can be determined in such a manner that continuous formation of the print target in the state where image quality is degraded is correctly suppressed.

While the frequency of determination of the discharging unit D where the frequency of discharge of ink is high is set to be high in the above embodiment, the discharging unit D that is frequently determined is not limited to this.

For example, when the frequency of discharge of ink is low in the discharging unit D that discharges viscous ink, ink is likely to be thickened inside the cavity 220. In such a case, by setting the frequency of determination of the discharging unit D where the frequency of discharge of ink is low to be high, the discharging unit D in which an abnormal discharge is likely to occur is preferentially inspected, and the complementation process can be performed early on the abnormal discharge of the discharging unit D.

The control unit 11 does not necessarily need to perform the complementation process on the discharging unit D in which an abnormal discharge is determined to occur. For example, the maintenance process may be performed on the discharging unit D in which an abnormal discharge is determined to occur. Even in such a case, by setting the frequency of determination of the discharging unit D where the frequency of discharge of viscous ink is low to be high, the discharging unit D in which an abnormal discharge is likely to occur is preferentially inspected. In addition, by performing the maintenance process on the discharging unit D, an advance in thickening of ink inside the cavity 220 is suppressed.

As such, by setting the frequency of determination of the discharging unit D where the frequency of discharge of ink is low to be high, the discharge state of the plurality of discharging units D can be determined in such a manner that continuous formation of the print target in the state where image quality is degraded is suppressed.

In the above embodiment, of the discharging units D that respectively discharge four color ink, the frequency of determination of the discharging unit D belonging to one specific color is set to be higher than the frequency of determination of the discharging unit D belonging to each of the other three colors. However, the frequency of determination of the discharging unit D is not limited to this and may be different per color to which the inspection target discharging unit D belongs. For example, the frequency of determination of the discharging unit D belonging to one specific color may be set to be lower than the frequency of determination of the discharging units D belonging to the other three colors.

For example, when the frequency of discharge of ink in the discharging unit D belonging to a specific color is lower than that in the discharging unit D belonging to another color, the frequency of determination of the discharging unit D belonging to the specific color may be set to be lower than the frequency of determination of the discharging unit D belonging to the other color. In addition, for example, regarding the color of a dot such as yellow that does not stand out, the frequency of determination of the discharging unit D belonging to the color may be set to be lower than the frequency of determination of the discharging unit D belonging to another color. According to such a configuration, an abnormal discharge occurring in the discharging unit D that belongs to a color other than the color for which the frequency of determination is set to be low can be detected early in comparison with the case where the discharging unit D belonging to each color is equally set as the inspection target.

The frequency of determination of the discharging unit D belonging to each color may be set to three stages or four stages, or the frequency of determination may be set to be higher for the discharging units D belonging to two of four color inks than for the discharging units D belonging to the other two colors.

The point is that as long as the frequency of determination of one discharging unit D is configured to be set to be higher than the frequency of determination of another one discharging unit D, an abnormal discharge of the discharging unit D of which the frequency of determination is relatively high is detected early, and a counteraction to the abnormal discharge can be performed early. The discharging unit D of which the frequency of determination is set to be high may be determined by characteristics of ink such as the viscosity and the frequency of discharge of ink, the content of the print target, a type of measure that is performed to counteract an abnormal discharge, and the like.

While the above embodiment is illustrated by the case where the printer 10 includes four ink cartridges 31 corresponding to four colors of CMYK, the printer 10 is not limited to this and may include three or less or five or more ink cartridges 31 corresponding to three or less colors or five or more colors. In addition, the printer 10 may include the ink cartridge 31 that is filled with color ink different from four colors of CMYK or may include only the ink cartridge 31 that corresponds to ink of a part of the four colors.

While the operation period of the printer 10 is classified into the printing unit operation period Tup in which the printing process is performed and the inspection unit operation period Tuj in which the discharge state determination process is performed in the above embodiment, the operation period of the printer 10 is not limited to this. The printing process and the discharge state determination process may be performed in the same unit operation period Tu. That is, the operation period of the printer 10 may include the unit operation period Tu in which both of the printing process and the discharge state determination process are performed.

In this case, for example, instead of supplying the drive signal Vin used in printing that has the waveform DpBB configured of the unit waveform PB1 and the unit waveform PB2 to the non-recording discharging unit D that does not form a dot, the drive signal Vin used in inspection having the waveform DpT may be supplied thereto while the drive signal Vin used in printing is supplied to the discharging unit D that forms a dot, and the discharge state determination process may be performed only on the non-recording discharging unit D. In this case, the discharge state determination process that is performed between the start of the printing process performed on one recording paper P and the start of the printing process performed on the recording paper P subsequent to the one recording paper P is regarded as one instance of the discharge state inspection.

In the present embodiment, the discharge state determination process is assumed to be so-called "non-discharging inspection" that determines the state of ink discharged from the discharging unit D on the basis of residual vibration occurring in the discharging unit D when the discharging unit D is driven in such a manner that ink is not discharged. However, the discharge state determination process is not limited thereto and may be so-called "discharge inspection" that determines the state of ink discharged from the discharging unit D on the basis of residual vibration occurring in the discharging unit D when the discharging unit D is driven in such a manner that ink is discharged.

Specific forms of performing the discharge state determination process as the discharge inspection can be illustrated as, for example, the following two forms.

A first form is to perform the discharge state determination process by detecting residual vibration occurring in the discharging unit D when the discharging unit D discharges ink to form the print target represented by the print data PD in the printing process. In the first form, the discharge state determination process is performed at the same time as the printing process.

A second form is to perform the discharge state determination process by discharging ink from the discharging unit D at a timing during the printing process is not performed to detect residual vibration occurring in the discharging unit D.

In the second form, the image quality of the print target to be formed on the recording paper P decreases if the ink discharged from the discharging unit D for the discharge state determination process is attached to the printing region Fp of the recording paper P. Thus, in the second form, it is necessary for the ink discharged from the discharging unit D for the discharge state determination process not to hit the printing region Fp of the recording paper P. In order for the ink discharged from the discharging unit D not to hit the printing region Fp during the discharge state determination process, for example, the printer 10 includes a moving mechanism that moves the carriage 30 on which the head unit 20 including the recording head 21 is mounted, and the discharge state determination process is performed after the moving mechanism moves the carriage 30 to a position where the ink discharged from the discharging unit D does not hit the printing region Fp. In addition, in order for the ink discharged from the discharging unit D not to hit the printing region Fp during the discharge state determination process, for example, the discharge state determination process may be performed at a timing other than the printing unit operation period Tup in which the printing process is performed.

While the recording head 21 includes eight nozzle arrays Ln (Ln-BK1 to Ln-YL2) in the above embodiment, the recording head 21 is not limited to this and may include at least two or more nozzle arrays Ln. In addition, while the recording head 21 includes the nozzle arrays Ln, every two of which includes the nozzles N discharging the same color ink, the number of nozzle arrays Ln of the same color is not limited to two. For example, the recording head 21 may be configured to include the nozzle arrays Ln, every one of which includes the nozzles N discharging the same color ink.

The recording head 21 may include the nozzle arrays Ln, every two of which includes the nozzles N discharging the same color ink, and these nozzle arrays Ln may be arranged in the same range in the Y-axis direction. That is, all of the nozzles N included in each nozzle array Ln may be the overlapping nozzle.

While the above embodiment is illustrated by the nozzle array Ln in which the M nozzles N are arranged in a zigzag form as nozzle groups Ln-BK1 to Ln-YL2 formed in the nozzle formed regions R-BK1 to R-YL2, the M nozzles N constituting the nozzle groups Ln-BK1 to Ln-YL2 are not limited to this and may be arranged in any form in the nozzle formed regions R-BK1 to R-YL2. For example, the M nozzles N constituting the nozzle groups Ln-BK1 to Ln-YL2 may be linearly arranged in one array in the Y-axis direction in the nozzle formed regions R-BK1 to R-YL2. In addition, for example, the M nozzles N constituting the nozzle groups Ln-BK1 to Ln-YL2 may be arranged into a matrix in the nozzle formed regions R-BK1 to R-YL2.

While the head driver 22 generates the drive signal Vin to be supplied to the plurality of (8M) discharging units D on the basis of the same drive waveform signal Com in the above embodiment, the form of generating the drive signal Vin is not limited to this.

The head driver 22, for example, may generate the drive signal Vin per nozzle group on the basis of a plurality of drive waveform signals Com that corresponds one-to-one to a plurality of nozzle groups (nozzle arrays Ln). In this case, the control unit 11 may supply the plurality of drive waveform signals Com corresponding one-to-one to the plurality of nozzle groups to the head driver 22. In addition, in this case, the head driver 22, for example, may include a plurality of drive signal generating units 23 that corresponds one-to-one to the plurality of nozzle groups. Furthermore, in this case, the timing of the start of the unit operation period Tu (that is, the timing at which the latch signal LAT is active) may be different for each nozzle group.

The head driver 22 may generate the drive signal Vin per ink color on the basis of a plurality of drive waveform signals Com that corresponds one-to-one to a plurality of colors of ink that the printer 10 can discharge. In this case, the control unit 11 may supply the plurality of drive waveform signals Com corresponding one-to-one to the plurality of ink colors to the head driver 22. In addition, in this case, the head driver 22, for example, may include a plurality of drive signal generating units 23 that corresponds one-to-one to the plurality of ink colors.

While the abnormal discharge detecting unit 24 includes a plurality of abnormal discharge detecting circuits CT that corresponds one-to-one to the plurality of (8M) discharging units D in the above embodiment, the abnormal discharge detecting unit 24 is not limited to this and may include at least one abnormal discharge detecting circuit CT. In this case, in one inspection unit operation period Tuj that belongs to the operation period during which one instance of the discharge state inspection is performed, the control unit 11 may select one discharging unit D as the target of the discharge state determination process from the plurality of discharging units D that is the target of the discharge state inspection in that instance and may supply the switching control signal Sw that causes the selected discharging unit D to be electrically connected to the abnormal discharge detecting circuit CT to the switching unit 25.

While determination of the state of ink discharged from the discharging unit D is performed in the discharge state determining unit 26 in the above embodiment, determination of a discharge state is not limited to this and may be performed in the control unit 11. When the control unit 11 performs determination of a discharge state, the abnormal discharge detecting circuit CT may be configured to not include the discharge state determining unit 26, and the detection signal Tc generated by the detecting unit 29 may be output to the control unit 11.

While the drive waveform signal Com includes three signals of Com-A, Com-B, and Com-C in the above embodiment, the drive waveform signal Com is not limited to this and may be configured of one signal (for example, only Com-A) or may be configured of two or more signals (for example, Com-A and Com-B).

While the control unit 11 simultaneously supplies the drive waveform signals Com-A and Com-B for generating the drive signal Vin used in printing (hereinafter, referred to as "printing drive waveform signal") as well as the drive waveform signal Com-C for generating the drive signal Vin used in inspection (hereinafter, referred to as "inspection drive waveform signal") as the drive waveform signal Com during each unit operation period Tu in the above embodiment, the form of supplying these signals is not limited to this.

For example, the control unit 11 may change the waveform of each signal included in the drive waveform signal Com according to the type of process performed in each unit operation period Tu, such as supplying the drive waveform signal Com that includes only the printing drive waveform signal (for example, the drive waveform signal Com that includes only Com-A and Com-B) during the printing unit operation period Tup and supplying the drive waveform signal Com that includes only the inspection drive waveform signal (for example, the drive waveform signal Com that includes only Com-C) during the inspection unit operation period Tuj. The number of bits of the printing signal SI is not limited to three and may be appropriately determined by the number of levels to be displayed or the number of signals included in the drive waveform signal Com.

While the print data generating unit 70 is disposed in the host computer 50 in the above embodiment, the print data generating unit 70 may be disposed in the printer 10. In this case, the control unit 11 performs the print data generation process. In such a configuration, the function of the print data generating unit 70 may be realized by, for example, the control unit 11 of the printer 10 executing the control program for the printer 10 retained by the storage unit 14.

The printer 10 may be an apparatus that forms a print target on a recording paper having a long shape. In this case, the recording paper that is wound onto a roll is unwound and is supplied to the top of the platen 41. In the printing process, the printer 10 divides the recording paper into a plurality of printing regions and a marginal region that partitions the plurality of printing regions and forms the print target in each printing region. The discharge state determination process that is performed between the start of the printing process performed on one printing region and the start of the printing process performed on the subsequent printing region is regarded as one instance of the discharge state inspection.

What is claimed is:

1. A printing apparatus comprising:

a first piezoelectric element;

a first cavity that is filled with a first liquid, the pressure inside the first cavity being increased or decreased by displacement of the first piezoelectric element;

a first nozzle that communicates with the first cavity and discharges the first liquid as a liquid drop by an increase or a decrease in the pressure inside the first cavity;

a second piezoelectric element;

a second cavity that is filled with a second liquid, the pressure inside the second cavity being increased or decreased by displacement of the second piezoelectric element;

a second nozzle that communicates with the second cavity and discharges the second liquid as a liquid drop by an increase or a decrease in the pressure inside the second cavity;

a drive signal generating unit that generates a drive signal displacing the first piezoelectric element as well as the second piezoelectric element, causes a first residual vibration signal to occur in the first piezoelectric element in response to an increase or a decrease in the pressure inside the first cavity due to application of the drive signal to the first piezoelectric element, and causes a second residual vibration signal to occur in the second piezoelectric element in response to an increase or a decrease in the pressure inside the second cavity due to application of the drive signal to the second piezoelectric element;

a residual vibration detecting unit that detects the first residual vibration signal and the second residual vibration signal;

a discharge state determining unit that determines the state of discharge from the first nozzle from the first residual vibration signal and determines the state of discharge from the second nozzle from the second residual vibration signal; and a setting unit that sets the frequency of detection of the first residual vibration signal to be higher than the frequency of detection of the second residual vibration signal.

2. The printing apparatus according to claim 1, further comprising:

a third piezoelectric element;

a third cavity that is filled with a third liquid, the pressure inside the third cavity being increased or decreased by displacement of the third piezoelectric element; and a third nozzle that communicates with the third cavity and discharges the third liquid as a liquid drop by an increase or a decrease in the pressure inside the third cavity, wherein the drive signal generated by the drive signal generating unit displaces the third piezoelectric element and causes a third residual vibration signal to occur in the third piezoelectric element in response to an increase or a decrease in the pressure inside the third cavity due to application of the drive signal to the third piezoelectric element, the residual vibration detecting unit further detects the third residual vibration signal, the discharge state determining unit further determines the state of discharge from the third nozzle from the third residual vibration signal, and the setting unit sets the frequency of detection of the first residual vibration signal to be higher than each of the frequency of detection of the second residual vibration signal and the frequency of detection of the third residual vibration signal.

3. The printing apparatus according to claim 2, wherein the frequency of discharge of the first liquid from the first nozzle is higher than each of the frequency of discharge of the second liquid from the second nozzle and the frequency of discharge of the third liquid from the third nozzle.

4. The printing apparatus according to claim 2, wherein the first liquid is black ink, and each of the second liquid and the third liquid is ink of one of cyan, magenta, and yellow.

5. The printing apparatus according to claim 2, wherein detection of the first residual vibration signal is performed after detection of the second residual vibration signal and after detection of the third residual vibration signal.

6. A control method for a printing apparatus including a first piezoelectric element, a first cavity that is filled with a first liquid, the pressure inside the first cavity being increased or decreased by displacement of the first piezoelectric element, a first nozzle that communicates with the first cavity and discharges the first liquid as a liquid drop by an increase or a decrease in the pressure inside the first cavity, a second piezoelectric element, a second cavity that is filled with a second liquid, the pressure inside the second cavity being increased or decreased by displacement of the second piezoelectric element, a second nozzle that communicates with the second cavity and discharges the second liquid as a liquid drop by an increase or a decrease in the pressure inside the second cavity, a drive signal generating unit that generates a drive signal displacing the first piezoelectric element as well as the second piezoelectric element, causes a first residual vibration signal to occur in the first piezoelectric element in response to an increase or a decrease in the pressure inside the first cavity due to application of the drive signal to the first piezoelectric element, and causes a second residual vibration signal to occur in the second piezoelectric element in response to an increase or a decrease in the pressure inside the second cavity due to application of the drive signal to the second piezoelectric element, a residual vibration detecting unit that detects the first residual vibration signal and the second residual vibration signal, and a discharge state determining unit that determines the state of discharge from the first nozzle from the first residual vibration signal and determines the state of discharge from the second nozzle from the second residual vibration signal, wherein the frequency of detection of the first residual vibration signal is set to be higher than the frequency of detection of the second residual vibration signal.

7. A non-transitory computer-readable medium storing a control program that causes a printing apparatus including a first piezoelectric element, a first cavity that is filled with a first liquid, the pressure inside the first cavity being increased or decreased by displacement of the first piezoelectric element, a first nozzle that communicates with the first cavity and discharges the first liquid as a liquid drop by an increase or a decrease in the pressure inside the first cavity, a second piezoelectric element, a second cavity that is filled with a second liquid, the pressure inside the second cavity being increased or decreased by displacement of the second piezoelectric element, a second nozzle that communicates with the second cavity and discharges the second liquid as a liquid drop by an increase or a decrease in the pressure inside the second cavity, a drive signal generating unit that generates a drive signal displacing the first piezoelectric element as well as the second piezoelectric element, causes a first residual vibration signal to occur in the first piezoelectric element in response to an increase or a decrease in the pressure inside the first cavity due to application of the drive signal to the first piezoelectric element, and causes a second residual vibration signal to occur in the second piezoelectric element in response to an increase or a decrease in the pressure inside the second cavity due to application of the drive signal to the second piezoelectric element, a residual vibration detecting unit that detects the first residual vibration signal and the second residual vibration signal, and a discharge state determining unit that determines the state of discharge from the first nozzle from the first residual vibration signal and determines the state of discharge from the second nozzle from the second residual vibration signal to function as a setting unit which sets the frequency of detection of the first residual vibration signal to be higher than the frequency of detection of the second residual vibration signal.

* * * * *